US008090277B2

(12) United States Patent
Hitaka

(10) Patent No.: US 8,090,277 B2
(45) Date of Patent: Jan. 3, 2012

(54) IMAGE FORMING APPARATUS

(75) Inventor: Masatoshi Hitaka, Sagamihara (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 197 days.

(21) Appl. No.: 12/637,313

(22) Filed: Dec. 14, 2009

(65) Prior Publication Data

US 2010/0150583 A1 Jun. 17, 2010

(30) Foreign Application Priority Data

Dec. 16, 2008 (JP) ..... 2008-319650

(51) Int. Cl.

| | |
|---|---|
| ***G03G 15/01*** | (2006.01) |
| ***G03G 15/00*** | (2006.01) |
| ***G03G 15/08*** | (2006.01) |
| ***G03G 21/00*** | (2006.01) |
| ***G03G 21/14*** | (2006.01) |

(52) U.S. Cl. ..... 399/29; 399/24; 399/27; 399/39; 347/140; 347/228

(58) Field of Classification Search ..... 399/25, 399/27, 28, 38–42, 54; 347/140, 228, 240, 347/251, 254

See application file for complete search history.

(56) References Cited

U.S. PATENT DOCUMENTS

| | | | | |
|---|---|---|---|---|
| 5,162,849 | A | 11/1992 | Yoshino et al. | |
| 2003/0049040 | A1 * | 3/2003 | Tezuka et al. | 399/49 |
| 2004/0196479 | A1 * | 10/2004 | Foster et al. | 358/1.9 |
| 2007/0092273 | A1 * | 4/2007 | Shiroki et al. | 399/27 |

FOREIGN PATENT DOCUMENTS

| | | | |
|---|---|---|---|
| JP | 04-190271 | A | 7/1992 |
| JP | 2001-337503 | A | 12/2001 |
| JP | 2002-6582 | A | 1/2002 |
| JP | 2005-144828 | A | 6/2005 |
| JP | 2006-023327 | A | 1/2006 |
| JP | 2008-249935 | A | 10/2008 |

OTHER PUBLICATIONS

Official Action issued Dec. 14, 2010, in corresponding Japanese Patent Application No. 2008-319650, and English language translation of the Official Action.

Official Action issued Mar. 15, 2011, in corresponding Japanese Patent Application No. 2008-319650, and English language translation of the Official Action.

* cited by examiner

*Primary Examiner* — David Porta
*Assistant Examiner* — Jessica L Eley
(74) *Attorney, Agent, or Firm* — Buchanan Ingersoll & Rooney PC

(57) ABSTRACT

In a copier having an image data converter that sets the C density, the M density and the Y density to a density obtained by multiplying the density of black in the RGB system by a CMY mixture ratio and sets the K density to a density obtained by multiplying the density of black by a K mixture ratio when black in the RGB system is converted into the CMYK system, the image data converter sets the K mixture ratio to a K reference mixture ratio when TK<PHK, and sets the K mixture ratio to a K high mixture ratio that is higher than the K reference mixture ratio when TK≧PHK. Here, TK is a K toner amount of consumption insufficiency which is a K toner amount to be consumed to prevent toner deterioration at the driving amount of the developing unit, and PHK is a K high predetermined value.

10 Claims, 24 Drawing Sheets

IMAGE FORMING APPARATUS

BACKGROUND OF THE INVENTION

1. Field of the Invention

The present invention relates to an image forming apparatus such as an electrophotographic copier and an electrophotographic printer.

2. Description of Related Art

For color printers, toners of four colors C, M, Y and K are normally prepared. The four colors C, M, Y and K are C (cyan), M (magenta) and Y (yellow) which are the three primary colors, and K (key plate, that is, black). Although black can be expressed by the three colors C, M and Y in theory, the mixture of C, M and Y cannot reproduce complete black in actuality. For this reason, not the mixture of the three colors C, M and Y but the single color K is used when black is expressed in printing.

Color printers are provided with an image process device for executing an image forming process, for each color. The image process device is provided with a photoreceptor (electrostatic latent image carrier), a charging unit, an exposing unit, a developing unit, a cleaner (cleaning blade), a transfer roller and the like as image process parts.

A color printer described in Patent Reference 1 is intended to prevent the above-mentioned image process parts for each color from deteriorating because of low frequencies of use of toners of C, M and Y. Specifically, the following situations are assumed: For example, when C, M and Y are used for a part of a printed image constituted mainly by black and white, the frequencies of use of C, M and Y are low compared with the frequency of use of K. However, when a color image is printed, the image process devices of the four colors are driven at the same time. At this time, the image process devices for C, M and Y are driven under a condition where the toner supply amount is small. When the amount of toner supplied to the photoreceptor is small, for example, the friction between the photoreceptor and the cleaning blade is high. Consequently, the cleaning blades for C, M and Y are damaged.

Accordingly, in the color printer described in Patent Reference 1, first, the frequency of use of each color is identified based on the amount of image information of each color included in the printed image. Then, when the frequency of use of at least one of C, M and Y is low, in the color printer, the toners of C, M and Y are mixed into the toner of K to an extent that the hue of black is not changed. By consuming the toners of C, M and Y in this way, the supply amounts of the toners of C, M and Y are increased.

[Patent Reference 1] Japanese Unexamined Patent Application Publication No. 2002-6582.

In printing processing, toner is supplied from the developing unit to the photoreceptor. The toner in the developing unit is held at a fixed amount. For this reason, toner is supplied from a toner tank to the developing unit so as to make up for the consumed toner. During the execution of printing processing, toner is being stirred in the developing unit. As the stirring time increases, toner is damaged. That is, deteriorated toner occurs. However, as long as toner is properly discharged from the developing unit by printing processing, the deteriorated toner is restrained from being accumulated in the developing unit.

When the density of the printed image is low, although the toner is stirred as usual, the toner discharge amount is smaller than normal. For this reason, the deteriorated toner that occurs by the stirring is not properly discharged. Consequently, the deteriorated toner is accumulated in the developing unit.

The deteriorated toner degrades the quality of printed images. Therefore, it is necessary to forcibly discharge the deteriorated toner in order to prevent the deteriorated toner from being accumulated in the developing unit in an amount not less than the fixed amount. The forcible discharge of the deteriorated toner is performed, for example, by supplying toner corresponding to solid printing from the developing unit to the photoreceptor. The toner supplied to the photoreceptor is removed by cleaning.

When the forcible discharge of toner is executed, normal toner is also consumed as well as the deteriorated toner. Consequently, the toner cartridge life is reduced. If the forcible discharge of toner is executed during the execution of continuous printing, continuous printing is intermitted. Consequently, the productivity of printing processing is reduced.

SUMMARY OF THE INVENTION

According to a first aspect of the invention, in an image forming apparatus provided with: a data obtainer that obtains image data of an RGB system; an image data converter that generates image data of a CMYK system having a C density, an M density, a Y density and a K density by converting the image data of the RGB system; an electrostatic latent image carrier where an electrostatic latent image corresponding to the image data of the CMYK system generated by the image data converter is formed; and a developing unit that stirs toners of C, M, Y and K to be supplied to the electrostatic latent image carrier, the following are provided: a driving amount calculator that calculates a driving amount of the developing unit from a predetermined time point in the past to a present time point; a K toner amount calculator of necessary consumption that calculates a K toner amount of necessary consumption corresponding to a K toner amount to be consumed to prevent toner deterioration at the driving amount; a K toner amount calculator of cumulative consumption that calculates a K toner amount of cumulative consumption corresponding to a K toner amount actually consumed at the driving amount; and a K toner amount calculator of consumption insufficiency that calculates a K toner amount of consumption insufficiency obtained by subtracting the K toner amount of the cumulative consumption from the K toner amount of the necessary consumption. In order that black in the image data of the RGB system is expressed by a mixture of four colors C, M, Y and K in the image data of the CMYK system, the image data converter sets the C density, the M density and the Y density to a density obtained by multiplying a density of black in the RGM system by a CMY mixture ratio, and sets the K density to a density obtained by multiplying the density of black by a K mixture ratio. The image data converter sets the K mixture ratio to a K high mixture ratio that is higher than the K reference mixture ratio when $TK \geqq PHK$ where TK is the K toner amount of the consumption insufficiency and PHK is a K high predetermined value.

According to a second aspect of the invention, in an image forming apparatus provided with: a data obtainer that obtains image data of an RGB system; an image data converter that generates image data of a CMYK system having a C density, an M density, a Y density and a K density by converting the image data of the RGB system; an electrostatic latent image carrier where an electrostatic latent image corresponding to the image data of the CMYK system generated by the image data converter is fromed; and a developing unit that stirs toners of C, M, Y and K to be supplied to the electrostatic latent image carrier, the following are provided: a driving amount calculator that calculates a driving amount of the developing unit necessary for printing the image data of the CMYK system based on the image data of the CMYK system; a K toner amount calculator of necessary consumption that calculates a K toner amount of necessary consumption corresponding to a K toner amount to be consumed to prevent toner deterioration at the driving amount; a K toner amount calculator of estimated consumption that calculates a K toner amount of estimated consumption which is a K toner amount necessary for printing the image data of the CMYK system; and a K toner amount calculator of estimated consumption insufficiency that calculates a K toner amount of estimated consumption insufficiency obtained by subtracting the K toner amount of the estimated consumption from the K toner amount of the necessary consumption. In order that black in the image data of the RGB system is expressed by a mixture of four colors C, M, Y and K in the image data of the CMYK system, the image data converter sets the C density, the M density and the Y density to a density obtained by multiplying a density of black in the RGM system by a CMY mixture ratio, and sets the K density to a density obtained by multiplying the density of black by a K mixture ratio. The image data converter sets the K mixture ratio to a K high mixture ratio that is higher than the K reference mixture ratio when TK≧PHK, where TK is the K toner amount of the estimated consumption insufficiency and PHK is a K high predetermined value.

DETAILED DESCRIPTION OF THE INVENTION

Copiers as embodiments of the image forming apparatus of the present invention will be described.

First Embodiment

Structure of The Copier

Figure 1:
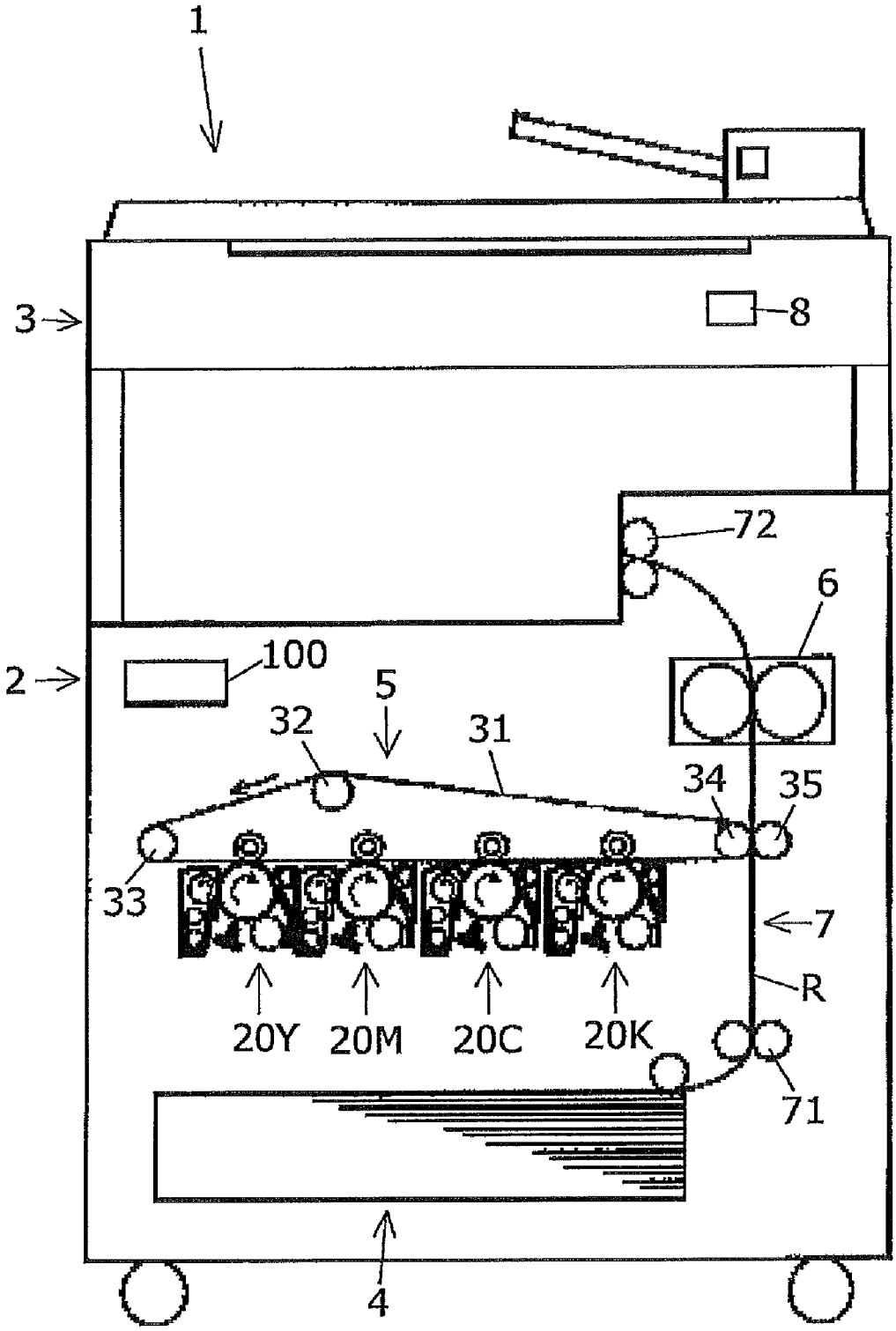
FIG. 1 is a central cross-sectional view of a copier.

FIG. 1 is a central cross-sectional view of a copier 1. As shown in FIG. 1, the copier 1 is provided with a printer 2, a scanner 3 and a control unit 100. The control unit 100 controls the printer 2 and the scanner 3.

The scanner 3 reads the image of the original, and creates image data. The scanner 3 is provided with a CCD 8. The CCD 8 is a data obtainer that obtains RGB system image data.

The printer 2 prints an image corresponding to the image data onto a sheet of paper. The printer 2 is provided with a paper feeding unit, an image process unit 5, a fixing unit 6 and a conveying unit 7. The paper feeding unit 4 sends out a sheet of paper to a conveyance path R. The image process unit 5 executes an image forming process, and transfers a toner image corresponding to the image data onto a sheet of paper. The fixing unit 6 fixes the toner image to the sheet. The conveying unit 7 is constituted by a plurality of rollers 71 and 72 arranged along the conveyance path R.

The image process unit 5 is provided with four cartridges 20Y, 20M, 20C and 20K, an intermediate transfer belt 31, rollers 32, 33 and 34, and a secondary transfer roller 35. The intermediate transfer belt 31 passes the four cartridges 20Y, 20M, 20C and 20K, and comes into contact with the conveyance path R. The rollers 32, 33 and 34 drive the intermediate transfer belt 31. The secondary transfer roller 35 is opposed to the intermediate transfer belt 31 with the conveyance path R in between.

The printer 2 is a color printer. Therefore, the image process unit 5 is provided with the four toner cartridges corresponding to image data of the CMYK system. Here, C represents cyan, M represents magenta, Y represents yellow, and K represents key plate (black).

Figure 2:
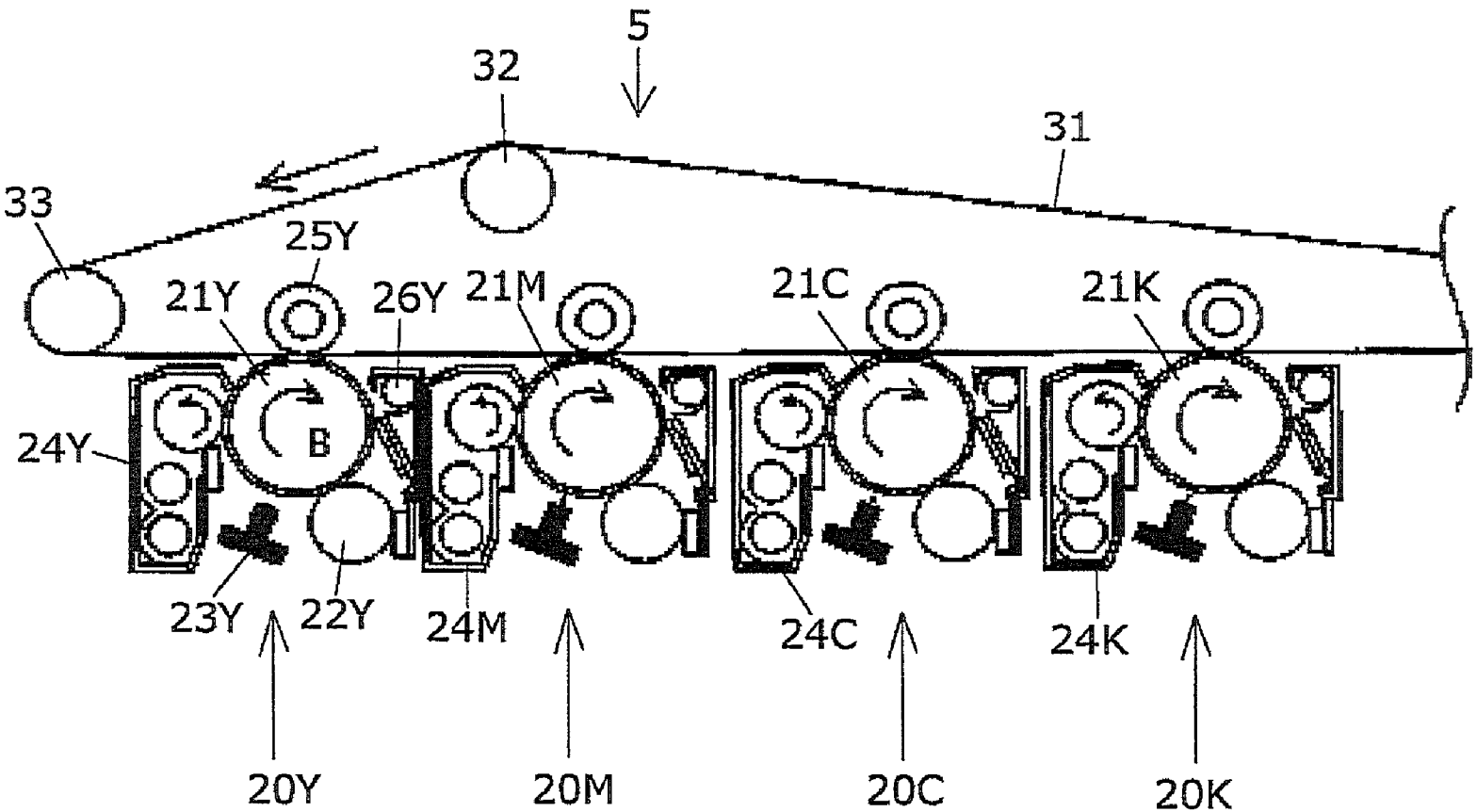
FIG. 2 is a front view showing the structure of four cartridges.

FIG. 2 is a front view showing the structure of the four cartridges 20Y, 20M, 20C and 20K. The four cartridges 20Y, 20M, 20C and 20K all have the same structure. Therefore, although the structure of the cartridge 20Y will be described, descriptions of the other cartridges 20M, 20C and 20K are omitted.

The cartridge 20Y is provided with a photoreceptor (electrostatic latent image carrier) 21Y, a charging unit 22Y, an exposing unit 23Y, a developing unit 24Y, a primary transfer roller 25Y and a cleaner 26Y. The charging unit 22Y uniformly charges the photoreceptor 21Y. The exposing unit 23Y exposes an appropriate part of the photoreceptor 21Y so that an electrostatic latent image corresponding to the printed image is formed on the photoreceptor 21Y. The developing unit 24Y stirs toner of Y in the inside thereof, and supplies toner of Y to the photoreceptor 21Y. Consequently, a toner image corresponding to the electrostatic latent image is formed on the photoreceptor 21Y. The primary transfer roller 25Y transfers the toner image on the photoreceptor 21Y onto the intermediate transfer belt 31. The cleaner 26Y removes the toner remaining after the transfer, from the intermediate transfer belt 31.

Figure 3:
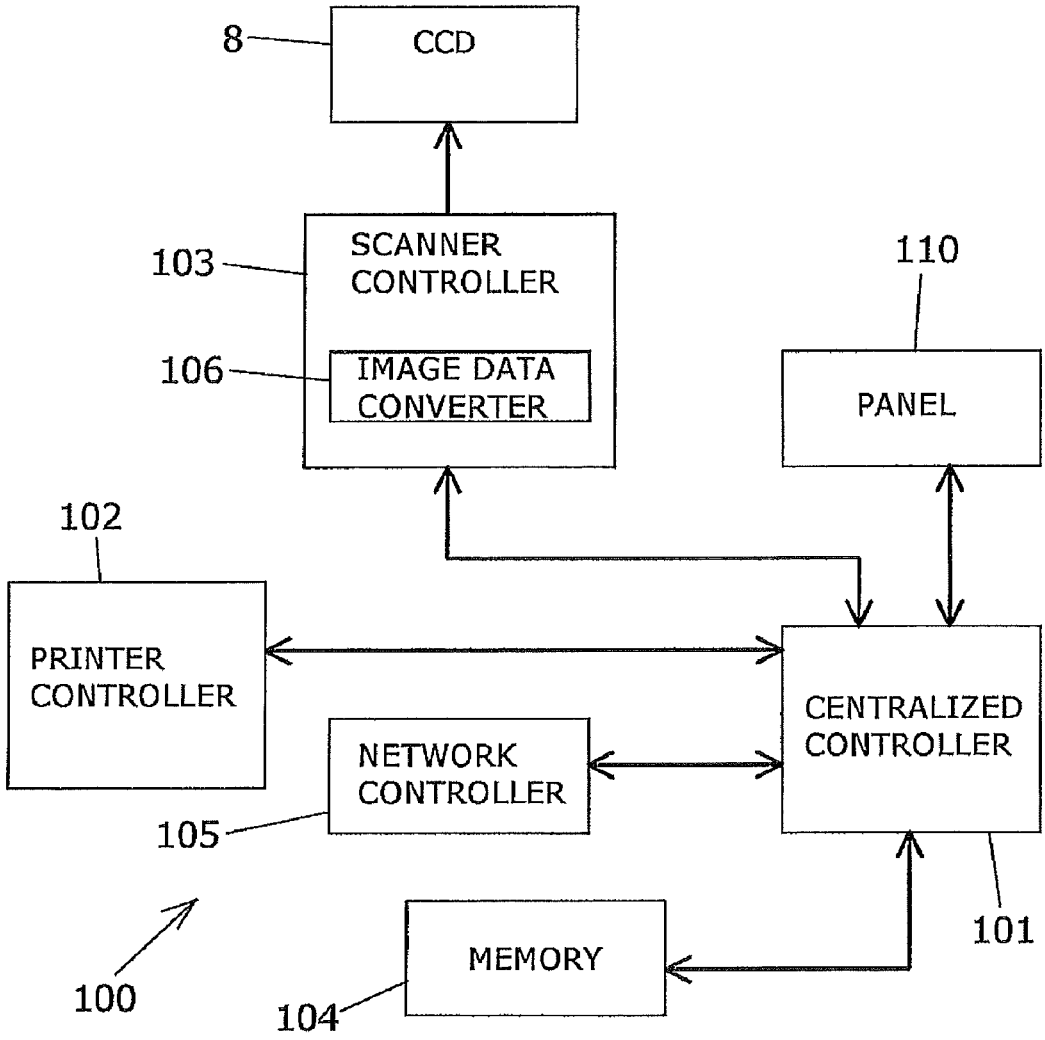
FIG. 3 is a block diagram showing the structure of a control unit.

FIG. 3 is a block diagram showing the structure of the control unit 100. The control unit 100 is provided with a centralized controller (CPU) 101, a printer controller 102, a scanner controller 103, a memory 104 and a network controller 105. The copier 1 is provided with an operation panel 110. The centralized controller 101, and the printer controller 102, the scanner controller 103, the memory 104, the network controller 105 or the operation panel 110 are connected by a communication line.

The printer controller 102 controls the printer 2. The scanner controller 103 controls the scanner 3. The memory 104 stores the image data outputted from the scanner 3. The network controller 105 controls a non-illustrated network communication unit. The operation panel 110 is means for the user to operate the copier 1.

The scanner controller 103 is provided with an image data converter 106. The CCD 8 reads the image of the original, and creates image data of the RGB system. The image data converter 106 converts the image data of the RGB system into image data of the CMYK system. The image data of the CMYK system is provided with a C density, an M density, a Y density and a K density.

The operation panel 110 is provided with means for input to the centralized controller 101 and means for output from the centralized controller 101. The input means is a key or the like. The output means is a display or the like.

In the copier 1, printing processing based on a printing instruction is executed in the following manner: Examples of the printing instruction include a copying instruction by direct input and a printing instruction from an external apparatus.

The copying instruction includes a reading instruction and a printing instruction. The user can input a copying instruction by using the operation panel 110. When the centralized controller 101 detects the input of a copying instruction, first, reading processing based on the reading instruction is executed. When the centralized controller 101 provides the scanner controller 103 with an instruction, image data of the RGB system is read from the original. Then, the image data converter 106 converts the read image data of the RGB system into image data of the CMYK system. Then, the image data of the CMYK system after the conversion is temporarily stored in the memory 104. Then, printing processing based on the printing instruction is executed. The centralized controller 101 transfers the image data of the CMYK system in the memory 104 to the printer controller 102. Then, the printer controller 102 executes printing processing based on the image data of the CMYK system.

The copier 1 is also capable of executing printing processing based on a printing instruction from an external apparatus. The external apparatus is, for example, a personal computer connected to the copier 1. The network controller 105 is capable of receiving printing instructions and image data from external apparatuses. When the network controller 105 detects the input of a printing instruction, the image data transmitted together with the printing instruction is temporarily stored in the memory 104. Then, printing processing is executed in a manner similar to that in the case of copying processing. That is, the network controller 105 functions as a data obtainer that obtains RGB system image data like the CCD 8. General image data readers can be used as the data obtainer.

[Controls Associated with Deteriorated Toner]

For the printer 2, a deteriorated toner forcible discharge control and a mixture ratio change control are provided as controls associated with the deteriorated toner. These controls will be described below in detail.

[Forcible Discharge of Deteriorated Toner]

Figure 4:
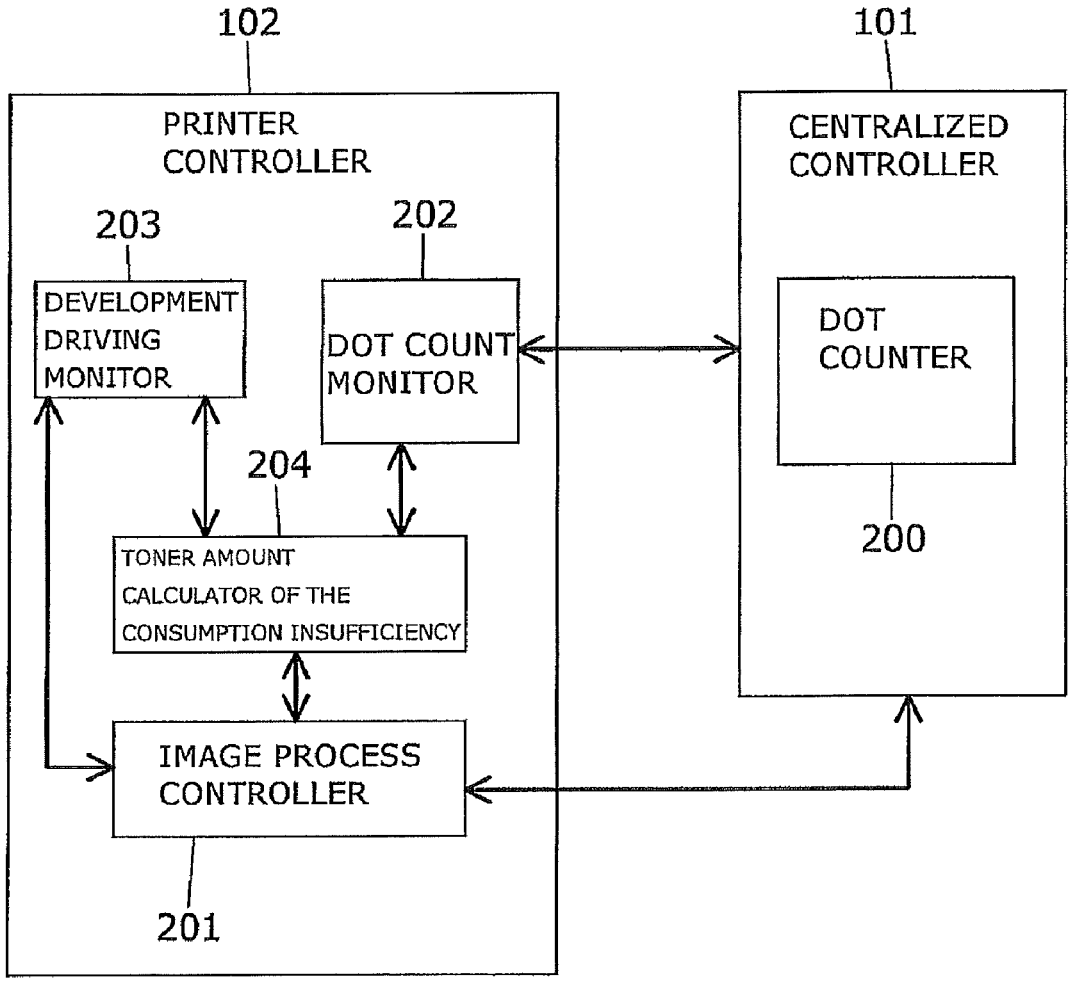
FIG. 4 is a block diagram related to a deteriorated toner forcible discharge control.

FIG. 4 is a block diagram related to the deteriorated toner forcible discharge control. The centralized controller 101 is provided with a dot counter 200. The printer controller 102 is provided with an image process controller 201, a toner amount calculator 204 of consumption insufficiency, a development driving monitor 203 and a dot count monitor 202.

The dot counter 200, the development driving monitor 203 and the dot count monitor 202 execute various counts. These counts are reset at the time point when the cartridge is changed or at the time point when the forcible discharge of toner is executed. The time point when the reset is executed will be referred to as a reset time point. The reset time point is set for each of C, M, Y and K.

When the image data for printing is transferred from the centralized controller 101 to the printer controller 102, the operation of the dot counter 200 is started. The dot counter 200 calculates the number of all the dots and the number of dots of each of C, M, Y and K included in one piece of transferred image data.

The image process controller 201 controls the image process unit 5 based on the printing instruction. Consequently, printing processing is executed. Printing processing is executed every time printing onto one sheet is performed. Hereinafter, printing processing for one sheet will refer to the processing of performing printing onto one sheet. Moreover, printing processing for one or a plurality of sheets is executed by one printing instruction.

The dot count monitor 202 detects the number of dots of each of C, M, Y and K included in one piece of image data transferred this time, based on the result of the calculation by the dot counter 200.

Further, the dot count monitor 202 (C, M, Y and K toner amount calculators of cumulative consumption) calculates the cumulative number of dots of each of C, M, Y and K for all the pieces of image data transferred after the previous reset time point. The cumulative number of C dots refers to the total number of C dots included in all the pieces of image data transferred during the period from the previous reset time point to the present time point. The cumulative numbers of dots of the other colors refer to numbers similar to the cumulative number of C dots. The reset time point is generally not the same among the colors. For this reason, the cumulative numbers of dots of the colors are generally not the same.

The toner amount can be set by using the number of dots as the unit. Since the weight of the toner necessary for printing one dot is fixed, the weight of toner can be identified based on the number of dots. In the present embodiment, the toner amount per dot is $1.14\times10^{-8}$ g. Hereinafter, the toner amount (dot) will refer to the toner amount that is set by using the number of dots as the unit.

Therefore, the dot count monitor 202 can calculate the toner amount of the cumulative consumption (dot).

The development driving monitor 203 monitors the presence or absence of driving of developing units 24C, 24M, 24Y and 24K.

Further, the development driving monitor 203 (driving amount calculator) calculates the cumulative driving time of each of the developing units 24C, 24M, 24Y and 24K based on the result of the monitoring. The cumulative driving time of the developing unit 24C is the sum of the driving times of the developing unit 24C during the period from the previous reset time point to the present time point. At the reset time point, the cumulative driving time is reset to 0.

Further, the development driving monitor 203 (C, M, Y and K toner amount calculators of necessary consumption) calculates a toner amount of necessary consumption of each color based on the cumulative driving time of each color. The toner amount of necessary consumption of C is an amount of C toner to be consumed to prevent C toner from deteriorating while the developing unit 24C is driven for a predetermined driving time. This applies to the other colors. The toner amounts of the necessary consumption of the colors are calculated by expressions (1) and (1a).

The toner amount of the necessary consumption (dot)=the number of dots of a predetermined size×(the cumulative driving time/the predetermined driving time) (1)

The toner amount of the necessary consumption (dot)=1600000 dots×(the cumulative driving time/2) (1a)

Here, the number of dots of a predetermined size refers to the amount of toner to be consumed when the developing unit is driven for the predetermined driving time. In the present embodiment, the number of dots of a predetermined size and the predetermined driving time are set in a case where printing is performed onto an A4 size sheet at 600 dpi (dot/inch) and at a density of 5%. The amount of toner necessary for printing onto an A4 size sheet at 600 dpi and at a density of 100% is appropriately 32000000 dots. Approximately 32000000=20 (cm)×(600/2.54)×29.7 (cm)×(600/2.54). The amount of toner necessary for printing at a density of 5% is approximately 1600000 dots. Therefore, the number of dots of a predetermined size is set to 1600000 dots. Since the driving time of the developing unit necessary for printing onto an PA size sheet is two seconds, the predetermined driving time is set to two seconds.

The toner amount calculator 204 of the consumption insufficiency (C, M, Y and K toner amount calculators of the consumption insufficiency) calculates, for each of C, M, Y and K, the toner amount of the consumption insufficiency of each color from the toner amount of the necessary consumption of each color and the toner amount of the cumulative consumption of each color. The toner amount of the necessary consumption of each color is transmitted from the development driving monitor 203 to the toner amount calculator 204 of the consumption insufficiency. The toner amount of the cumulative consumption of each color is transmitted from the dot count monitor 202 to the toner amount calculator 204 of the consumption insufficiency. The toner amount of the consumption insufficiency of each color is calculated by an expression (2).

The toner amount of the consumption insufficiency=the toner amount of the necessary consumption−the toner amount of the cumulative consumption (2)

Part of the toner amount of the consumption insufficiency is changed to the deteriorated toner. The relationship of an expression (3) holds between the deteriorated toner amount and the toner amount of the consumption insufficiency.

The deteriorated toner amount (dot)=the toner amount of the consumption insufficiency (dot)×a predetermined ratio (3)

In the forcible discharge of the deteriorated toner, toner is supplied from the developing unit to the photoreceptor, and removed without used for printing. In the present embodiment, toner is discharged from the developing unit so as to form a solid image having a breadth of 200 mm. In doing this, it is desirable to express the deteriorated toner amount by using, as the unit, the length (mm) of the solid image in the paper feed direction. The relationship of an expression (4) holds between the toner amount (mm) and the toner amount (dot). Naturally, the relationship of the expression (4) also holds between the deteriorated toner amount (mm) and the deteriorated toner amount (dot).

The toner amount (mm)=the toner amount (dot)/the total number of dots per 200 $mm^2$ (4)

Here, the total number of dots per 200 $mm^2$ is the total number of dots included in an area with a width of 200 mm and a length of 1 mm on a sheet of 600 dpi. That is, this total number of dots corresponds to the toner amount (dot) consumed when a solid image having a breadth of 200 mm is printed 1 mm in length.

Therefore, the relationship of an expression (5) holds between the deteriorated toner amount (mm) and the toner amount of the consumption insufficiency (dot) based the relationships of the expressions (3) and (4).

The deteriorated toner amount (mm)=the toner amount of the consumption insufficiency (dot)×(1/100000)×(1/10) (5)

Here, the 100000 of the second term is a conversion factor, and represents an estimate value of the total number of dots per 200 $mm^2$ of the expression (4). The (1/10) of the third term is the predetermined ratio of the expression (3).

The toner amount calculator 204 of the consumption insufficiency calculates not only the toner amount of the consumption insufficiency (dot) but also the deteriorated toner amount (mm) in the above-described manner. The result of calculation of the deteriorated toner (mm) is transmitted to the image process controller 201.

The image process controller 201 executes the forcible discharge of the deteriorated toner under a condition mentioned below. In the forcible discharge of the deteriorated toner, the toner of the deteriorated toner amount (mm) is discharged from the developing unit. After the toner of the deteriorated toner amount (mm) has been discharged from the developing unit, the deteriorated toner in the developing unit has substantially been removed.

After executing the forcible discharge of the deteriorated toner, the image process controller 201 transmits a reset request to the toner amount calculator 204 of the consumption insufficiency, the development driving monitor 203 and the dot count monitor 202. Based on the respective reset requests, the toner amount calculator 204 of the consumption insufficiency changes the toner amount of the consumption insufficiency of each color to 0, the development driving monitor 203 changes the cumulative driving time of each color to 0, and the dot count monitor 202 changes the cumulative number of dots of each color to 0.

Figure 5:
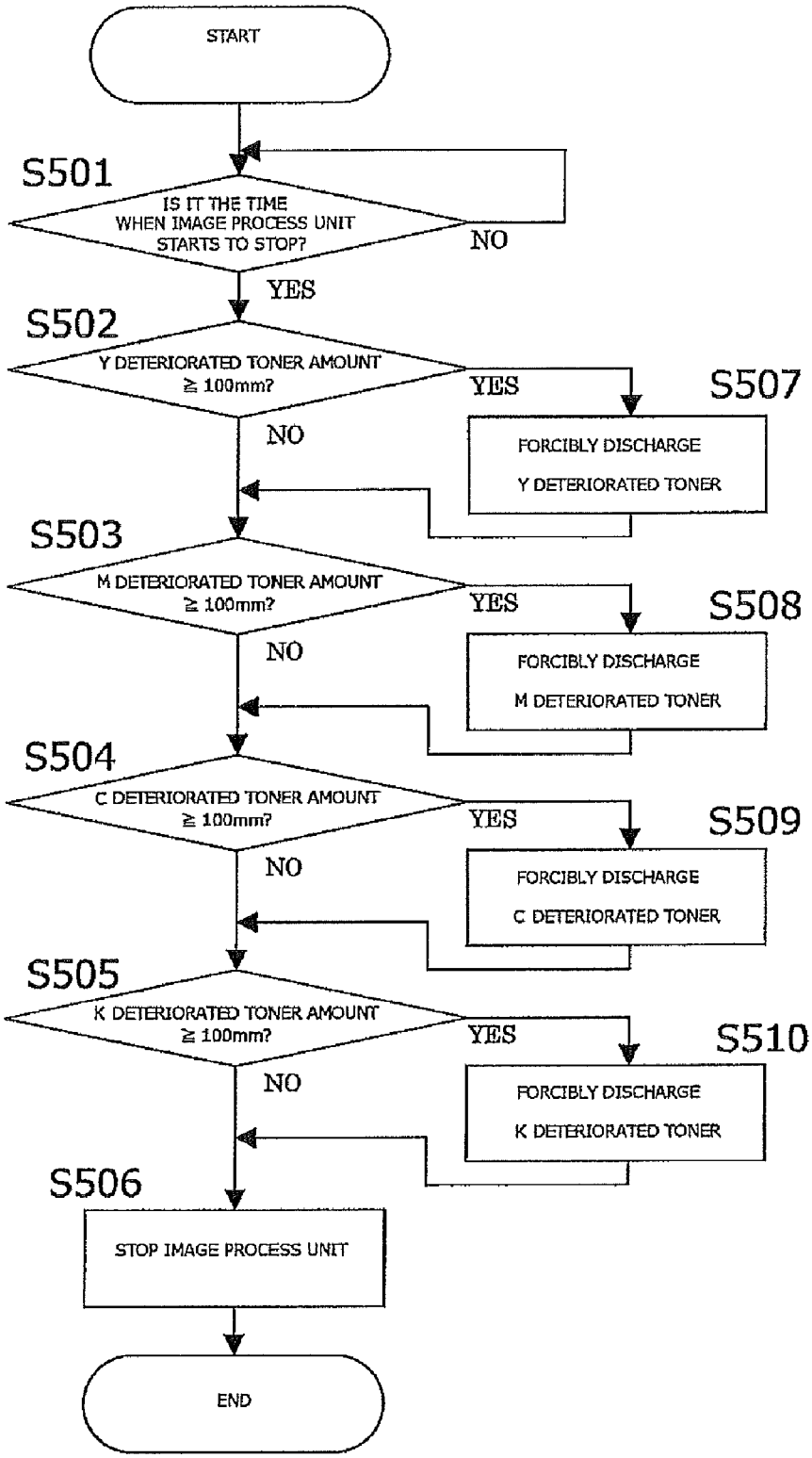
FIG. 5 is a flowchart of a deteriorated toner forcible discharge control before an image process unit is stopped (first embodiment)
Figure 6:
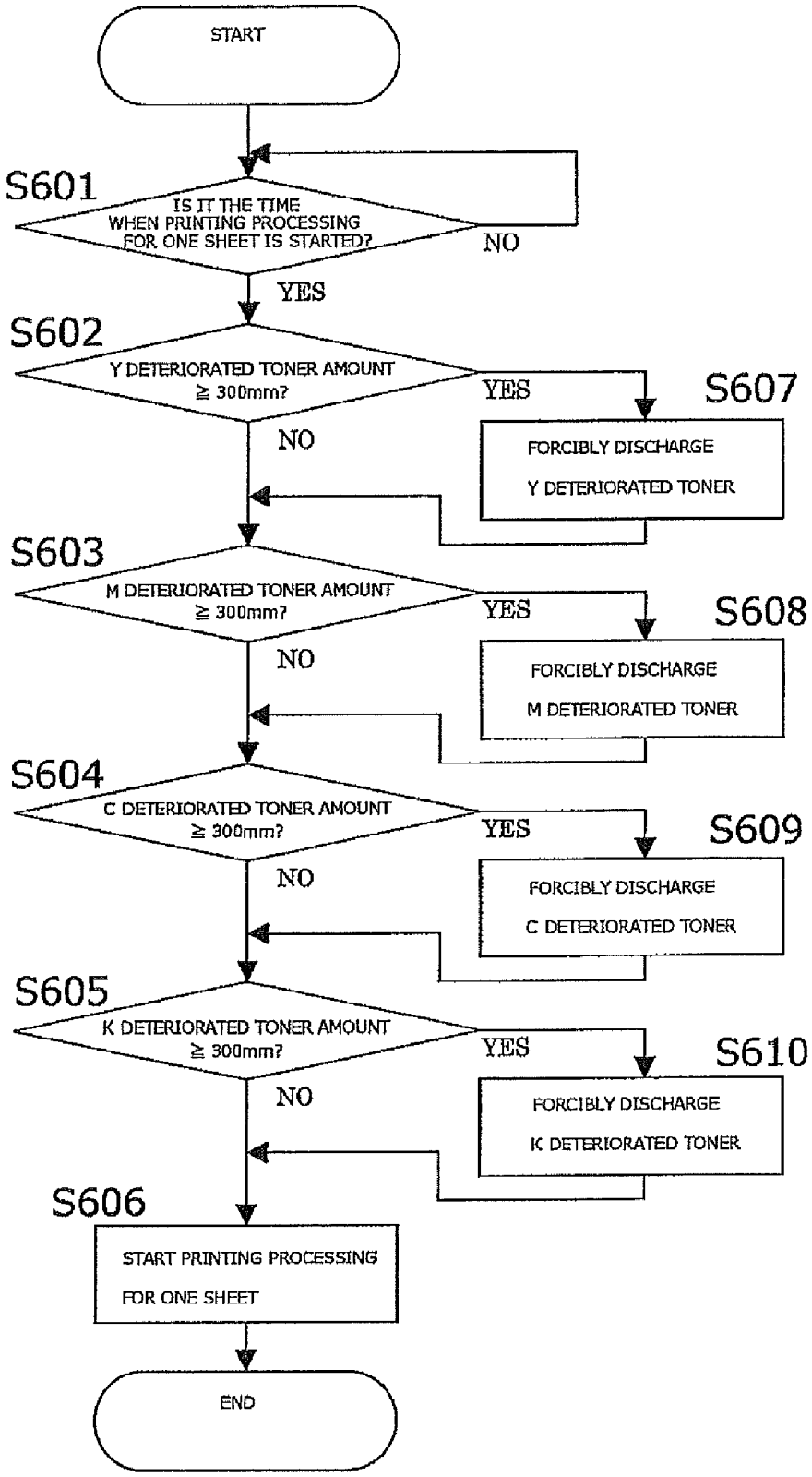
FIG. 6 is a flowchart of a deteriorated toner forcible discharge control during continuous printing (first embodiment)

FIGS. 5 and 6 show flowcharts of deteriorated toner forcible discharge controls. FIG. 5 is a flowchart of the deteriorated toner forcible discharge control before the image process unit 5 is stopped (first embodiment). FIG. 6 is a flowchart of the deteriorated toner forcible discharge control during continuous printing (first embodiment).

The image process controller 201 executes the forcible discharge of the deteriorated toner based on the flow of FIG. 5 and the flow of FIG. 6. The forcible discharge of the deteriorated toner is executed during the activation of the image process unit 5. One printing instruction is executed during the activation of the image process unit 5. That is, printing processing for one or a plurality of sheets is executed. Continuous printing refers to the execution of printing processing for a plurality of sheets. The flow of FIG. 5 is always executed after printing is all finished and before the image process unit 5 is stopped. The flow of FIG. 6 is executed between the previous printing processing for one sheet and the next printing processing for one sheet during the execution of continuous printing.

The flow, before the stopping, of FIG. 5 will be described. At step S501, the image process controller 201 determines whether it is the time when the image process unit 5 starts to stop or not. The set timing of starting stopping is after printing is all finished. When it is the time when the image process unit 5 starts to stop, the process proceeds to step S502. When it is not the time when the image process unit 5 starts to stop, the processing of step S501 is repeated.

At steps S502, S503, S504 and S505, the image process controller 201 determines whether the deteriorated toner amounts of Y, M, C and K are not less than 100 mm or not. When the deteriorated toner amount of each color is not less than 100 mm at each determination, the image process controller 201 executes the forcible discharge of the deteriorated toners of the corresponding colors at steps S507, S508, S509 and S510. When the determination is finished for the deteriorated toner amount of one color, the determination is performed for the deteriorated toner amount of the next color. When the determination is finished for the deteriorated toner amounts of all the four colors, the image process unit 5 is stopped at step S506.

The flow, during continuous printing, of FIG. 6 will be described. At step S601, the image process controller 201 determines whether it is the time when printing processing for one sheet is started or not. The set timing of starting printing processing for one sheet is, more specifically, between the previous printing processing for one sheet and the next printing processing for one sheet. When it is the time when the image process unit 5 starts, the process proceeds to step S602. When it is not the time when the image process unit 5 starts, the processing of step S601 is repeated.

At steps S602, S603, S604 and S605, the image process controller 201 determines whether the deteriorated toner amounts of Y, M, C and K are not less than 300 mm or not. When the deteriorated toner amount of each color is not less than 300 mm at each determination, the image process controller 201 executes the forcible discharge of the deteriorated toners of the corresponding colors at steps S607, S608, S609 and S610. When the determination is finished for the deteriorated toner amount of one color, the determination is performed for the deteriorated toner amount of the next color. When the determination is finished for the deteriorated toner amounts of all the four colors, the next printing processing for one sheet is started at step S606.

When the forcible discharge of the deteriorated toner is executed in the flow of FIG. 6, continuous printing is intermitted. For this reason, the threshold value (100 mm) of the flow, before the stopping, of FIG. 5 is set so as to be lower than the threshold value (300 mm) of the flow, during continuous printing, of FIG. 6.

[Mixture Ratio Setting]

Next, the mixture ratio setting will be described. The image data converter 106 expresses black in the RGB system by using K, C, M and Y in the CMYK system. That is, black is partially expressed by a mixture of C, M and Y. For this reason, the image data converter 106 sets the C density, the M density and the Y density to densities obtained by multiplying the density of black by a CMY mixture ratio, and sets the K density to a density obtained by multiplying the density of black by a K mixture ratio.

The K mixture ratio and the CMY mixture ratio are normally set to a K reference mixture ratio and a CMY reference mixture ratios, respectively. In an example, the K reference mixture ratio is 60%, and the CMY reference mixture ratio is 30%. When the density of black in the RGB system is 100%, in the CMYK system, the C density, the M density, the Y density and the K density are 30%, 30%, 30% and 60%, respectively.

[Mixture Ratio Change Control]

The image data converter 106 changes the mixture ratio of each color for expressing black, according to whether the deteriorated toner amount of each color satisfies a predetermined mixture change condition or not. Hereinafter, the mixture ratio of each color for expressing black will be referred to as a black area mixture ratio. In the present embodiment, the CMY mixture ratio and the K mixture ratio are changed according to the deteriorated toner amount of K.

Figure 7:
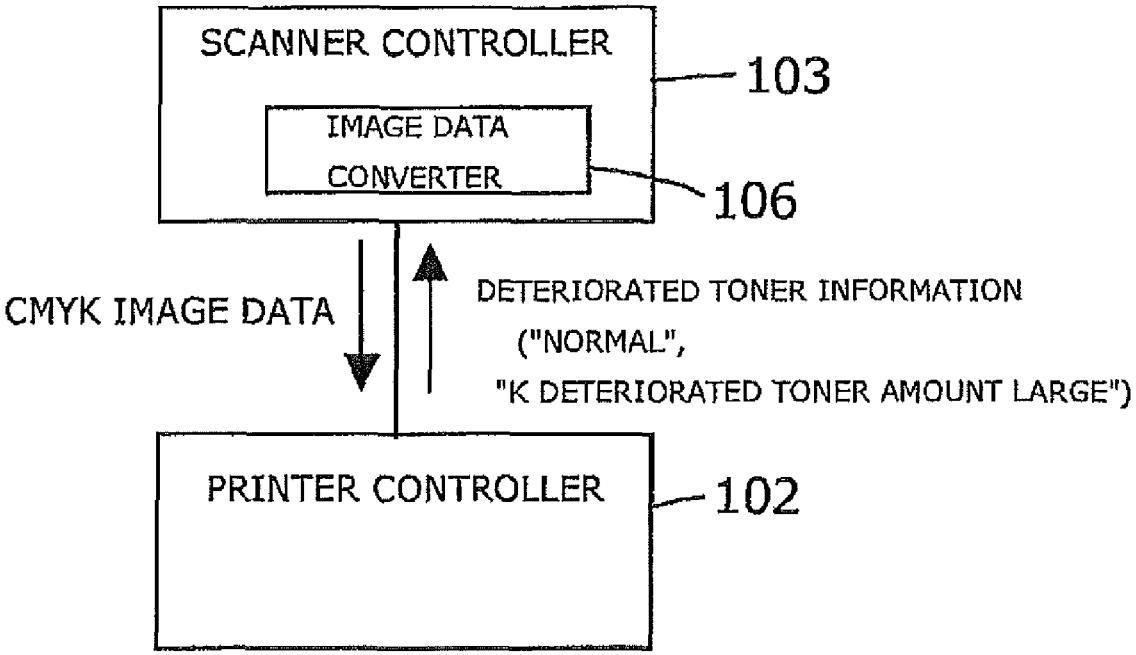
FIG. 7 is a view showing data exchanged between a printer controller and an image data converter (first embodiment)

FIG. 7 is a view showing data exchanged between the printer controller 102 and the image data converter 106 (first embodiment). As mentioned above, the printer controller 102 and the scanner controller 103 are connected so that communication is possible therebetween through the centralized controller 101. Data is exchanged between the printer controller 102 and the scanner controller 103 by serial communication.

Deteriorated toner information is transmitted from the printer controller 102 to the scanner controller 103. In the present embodiment, the deteriorate toner information has two values of "normal" and "K deteriorated toner amount large". When the information has two values, the deteriorated toner amount of K can be communicated by high and low of a hardware signal.

The mixture ratio change condition is whether the deteriorated toner amount of K is not less than a K high predetermined value or not. The K high predetermined value is set to 60 mm. When the deteriorated toner amount of K is not less than 60 mm, the deteriorated toner information is set to "K deteriorated toner amount large". On the other hand, when the deteriorated toner amount of K is less than 60 mm, the deteriorated toner information is set to "normal".

When the deteriorated toner information is "normal", the image data converter 106 sets the black area mixture ratio to "normal setting". In the "normal setting", the CMY mixture ratio is set to 30% (CMY reference mixture ratio), and the K mixture ratio is set to 60% (K reference mixture ratio). On the other hand, when the deteriorated toner information is "K deteriorated toner amount large", the image data converter 106 sets the black area mixture ratio to "K mixture ratio UP setting". In the "K mixture ratio UP setting", the CMY mixture ratio is set to a CMY low mixture ratio, and the K mixture ratio is set to a K high mixture ratio. In an example, the CMY low mixture ratio is 29%, and the K high mixture ratio is 61%. That is, the CMY mixture ratio is decreased 1%, and the K mixture ratio is increased 1%.

When the CMY mixture ratio and the K mixture ratio are changed, in the image data converter 106, image data of CMYK system is created based on the changed mixture ratios. The created image data of the CMYK system is transmitted from the scanner controller 103 to the printer controller 102.

An example of the deteriorated toner increase amount in continuous printing will be shown next. It is now assumed that printing processing for one sheet in continuous printing is printing processing onto an A4 size sheet at 600 dpi and at a K density of 3%. Therefore, the K toner consumption amount in printing processing onto one sheet in the printing processing for one sheet is 1050000 dots corresponding to the K toner consumption amount when printing onto an A4 size sheet is performed at 600 dpi and at a K density of 3%. As mentioned above, the amount of toner necessary for printing onto an A4 size sheet at 600 dpi and at a density of 100% is approximately 32000000 dots. The K deteriorated toner amount (mm) for one sheet in the "normal setting" is shown by an expression (5a).

$$\text{The K deteriorated toner amount (mm) for one sheet in the "normal setting"}=(1600000\ \text{dots}\times 2\div 2-1050000)\times(1/100000)=0.55\ \text{mm} \quad (5a)$$

The "1600000 dots" of the first term is the toner amount of the necessary consumption, the "2" of the second term is the cumulative driving time, the "2" of the third term is the predetermined driving time, the "1050000" of the fourth term is the cumulative number of dots, and the "(1/100000)" of the fifth term is the factor of conversion between dot and mm. The cumulative number of dots corresponds to the amount of toner consumed by printing processing for one sheet.

On the sheet, C, M and Y are each printed at a density of 1.5%.

In the "K mixture ratio UP setting", the K toner consumption amount in printing processing onto one sheet is larger by the amount corresponding to the mixture ratio compared with that in the "normal setting". That is, the cumulative number of dots in the "K mixture ratio UP setting" is equal to the cumulative number of dots×(61%/60%) in the "normal setting". The K deteriorated toner amount (mm) for one sheet in the "K mixture ratio UP setting" is shown by an expression (5b).

$$\text{The K deteriorated toner amount (mm) for one sheet in the "K mixture ratio UP setting"}=(1600000\ \text{dots}\times 2\div 2-1050000\times(61/60)\times(1/100000)=0.53\ \text{mm} \quad (5b)$$

The numbers of sheets when the threshold value 100 mm is reached in the cases of continuous printing in the "normal setting" and in the "K mixture ratio UP setting" are shown in the following:

In the case of the "normal setting", 100 mm÷0.55 mm=182 (sheets).

In the case of the "K mixture ratio UP setting", 100 mm÷0.53 mm=188 (sheets).

Therefore, a difference of 8 sheets occurs in the number of sheets onto which printing can be performed until the execution of the deteriorated toner forcible discharge.

While the density change amount is 1% in the present embodiment, the effect increases by increasing the change amount, for example, to 2% or 5%. While the CMY mixture ratio is decreased 1% when the K mixture ratio is increased 1% in the change of the mixture ratio in the present embodiment, the present invention is not limited to this structure. The CMY mixture ratio may make no change when the K mixture ratio is increased 1%.

Figure 8:
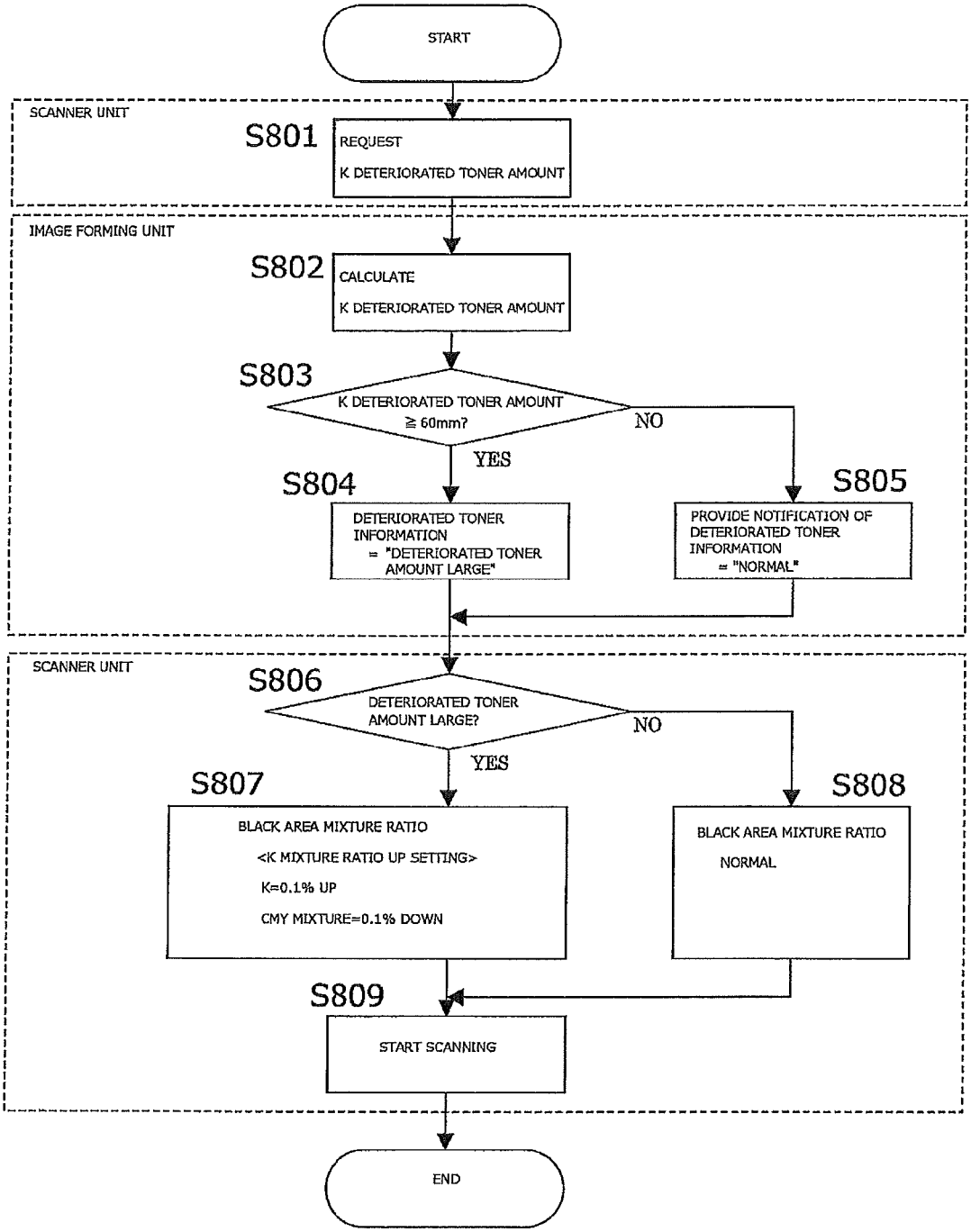
FIG. 8 is a flowchart of a mixture ratio change control before the start of copying processing (first embodiment)

FIG. 8 is a flowchart of a mixture ratio change control before the start of copying processing. The mixture ratio change control is executed before the start of copying processing involving reading processing.

When the centralized controller 101 detects the input of a copying instruction, the scanner controller 103 starts reading processing. At step S801, the scanner controller 103 requests the deteriorated toner information from the printer controller 102.

Steps S802 to S805 are executed by the printer controller 102. When the deteriorated toner information is requested, at step S802, the printer controller 102 calculates the deteriorated toner amount of each color. At the next step S803, the printer controller 102 determines whether the K deteriorated toner amount is not less than 60 mm or not. When the K deteriorated toner amount is not less than 60 mm, step S804 is executed, and when the K deteriorated toner amount is less than 60 mm, step S805 is executed. At step S804, the printer controller 102 transmits "K deteriorated toner amount large" to the scanner controller 103 as the deteriorated toner information. At step S805, the toner amount calculator 204 of the consumption insufficiency transmits "normal" to the scanner controller 103 as the deteriorated toner information.

Steps S806 and S809 are executed by the scanner controller 103. At step S806, the scanner controller 103 determines whether the deteriorated toner information is "K deteriorated toner amount large" or not. When the deteriorated toner information is "K deteriorated toner amount large", step S807 is executed, and when the deteriorated toner information is "normal", step S808 is executed. At step S807, the black area mixture ratio is set to the "K mixture ratio UP setting". At step S808, the black area mixture ratio is set to the "normal setting". When the black area mixture ratio is set, at step S809, the scanner controller 103 starts reading processing.

The read image data of the RGB system is converted, in the black area of this image data, into image data of the CMYK system based on the mixture ratio set in the latest setting.

Second Embodiment

Next, the copier 1 of a second embodiment will be described. The second embodiment is the same as the first embodiment except for the following difference: Between these embodiments, the mixture ratio change condition is different.

In the first embodiment, the mixture ratio is changed based only on the K deteriorated toner amount. For this reason, the deterioration of the toners of C, M and Y advances when the consumption amount of the K toner is small and the consumption the C, M and Y toner amounts are smaller than the consumption amount of the K toner. Therefore, in the second embodiment, the mixture ratio is changed based on the deteriorated toner amounts of all the colors. Specifically, in the second embodiment, first, the deteriorated toner amount of K is compared with the deteriorated toner amount of C, M or Y to identify which of the deteriorate toner amounts is relatively larger. Then, in the second embodiment, when the deteriorated toner amount of K is relatively large, the K mixture ratio is set to high, and when the deteriorated toner amount of K is relatively small, the K mixture ratio is set to normal.

Figure 9:
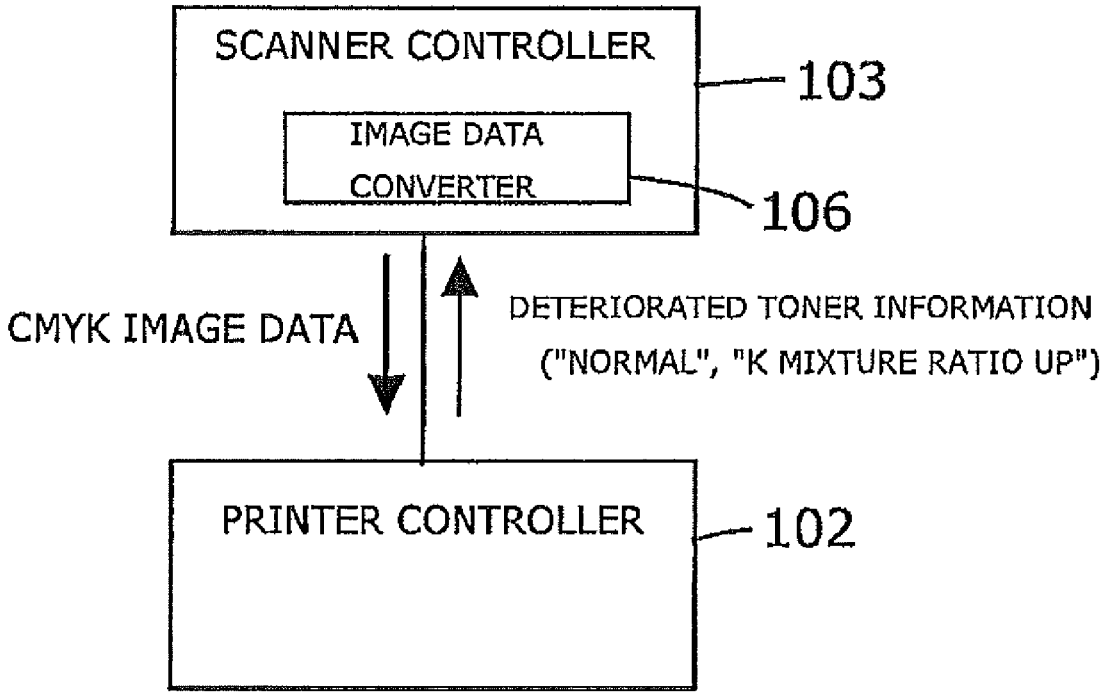
FIG. 9 is a view showing data exchanged between the printer controller and the image data converter (second embodiment)

FIG. 9 is a view showing data exchanged between the printer controller 102 and the image data converter 106 (second embodiment). The apparatus structure of FIG. 9 (second embodiment) is the same as that of FIG. 7 (first embodiment). Between these embodiments, the contents of the deteriorated toner information transmitted from the printer controller 102 to the scanner controller 103 are different.

In the second embodiment, the deteriorated toner information is "normal" or "K mixture ratio UP". The deteriorated toner information has two values. The deteriorated toner information is set to "normal" or "K mixture ratio UP" based on the mixture ratio change condition.

The mixture ratio change condition according to the second embodiment includes the K high predetermined value and a CMY low predetermined value. The K high predetermined value is 60 mm, and the CMY low predetermined value is 50 mm.

The mixture ratio change condition is as follows:

(U1) When a change from "normal" to "K mixture ratio UP" is made or "K mixture ratio UP" is maintained, the K deteriorated toner amount≧60 mm and the color deteriorated toner amount<50 mm.

(N) When a change from "K mixture ratio UP" to "normal" is made or "normal" is maintained, the K deteriorated toner amount and the color deteriorated toner amount do not satisfy the relationship (U1).

The color deteriorated toner amount refers to the largest one of the deteriorated toner amounts of C, M and Y. That the color deteriorated toner amount is less than 50 mm is equal to that all the deteriorated toner amounts of C, M and Y are less than 50 mm.

When the relationship (U1) of the mixture ratio change condition is satisfied, the K deteriorated toner amount is relatively larger than the deteriorated toner amounts of C, M and Y. At this time, the printer controller 102 sets the deteriorated toner information to "K mixture ratio UP". In response thereto, the image data converter 106 sets the black area mixture ratio to the "K mixture ratio UP setting". In the present embodiment, the CMY mixture ratio is set to 29%, and the K mixture ratio is set to 61%.

On the other hand, when the relationship (U1) of the mixture ratio change condition is not satisfied, the deteriorated toner information is set to "normal". In "normal", the black area mixture ratio is set to the "normal setting". In the present embodiment, the CMY mixture ratio is set to 30%, and the K mixture ratio is set to 60%.

Figure 10:
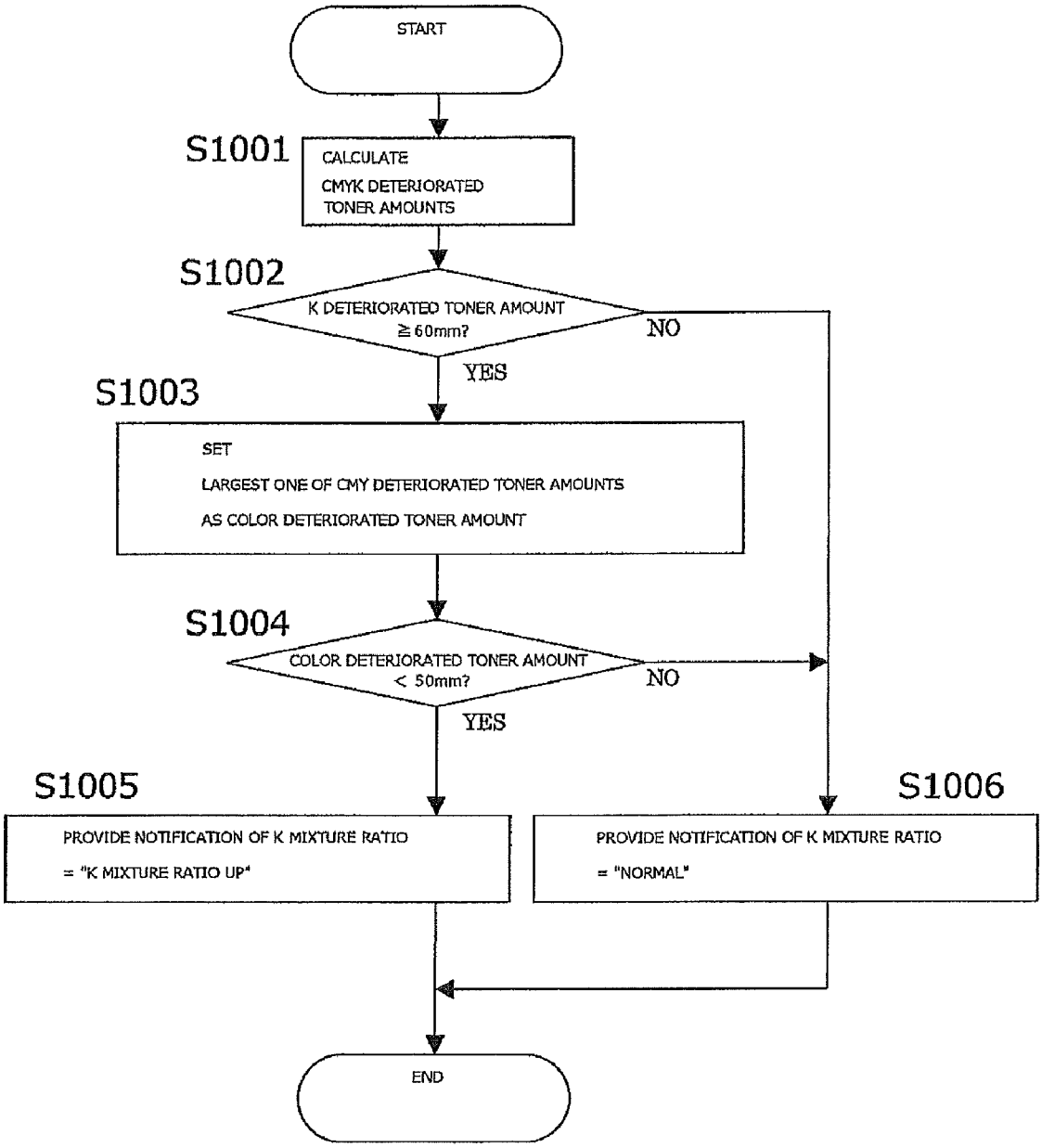
FIG. 10 is a flowchart for setting deteriorated toner information (second embodiment)

FIG. 10 is a flowchart for setting the deteriorated toner information. First, at step S1001, the printer controller 102 calculates the deteriorated toner amounts of all the colors. Then, at step S1002, the printer controller 102 determines whether the K deteriorated toner amount is not less than 60 mm or not. When the result of S1002 is NO, at S1006, the printer controller 102 sets the deteriorated toner information to "normal". On the other hand, when the result of step S1002 is YES, at S1003, the printer controller 102 sets the largest one of the deteriorated toner amounts of C, M and Y as the color deteriorated toner amount. At the next step S1004, the printer controller 102 determines whether the color deteriorated toner amount is less than 50 mm or not. When the result of step S1004 is NO, the process proceeds to step S1006. When the result of step S1004 is YES, the process proceeds to step S1005. At step S1005, the printer controller 102 sets the deteriorated toner information to "K mixture ratio UP".

The mixture ratio change condition includes that the color deteriorated toner amount is less than 50 mm. Fifty mm is sufficiently smaller than the threshold value 100 mm in the forcible discharge of the deteriorated toner amounts of C, M and Y. Even if the color deteriorated toner amount reaches 50 mm, a margin of 50 mm is still left. That is, the condition of the color deteriorated toner≦50 mm means a range in which the color deteriorated toner amount may be increased by the "K mixture ratio UP setting".

In the present embodiment, the threshold value 100 mm in the forcible discharge of the deteriorated toner amounts of C, M and Y is the same. The flow of FIG. 8 is also applied to the second embodiment. Accordingly, the threshold value 50 mm of the permissible range of the deteriorated toner amounts of C, M and Y in the mixture ratio change condition is the same. When the threshold value in the forcible discharge is different among the colors, the threshold values of the colors in the mixture ratio change condition are also changed in accordance with the threshold values of the colors in the forcible discharge.

Figure 11:
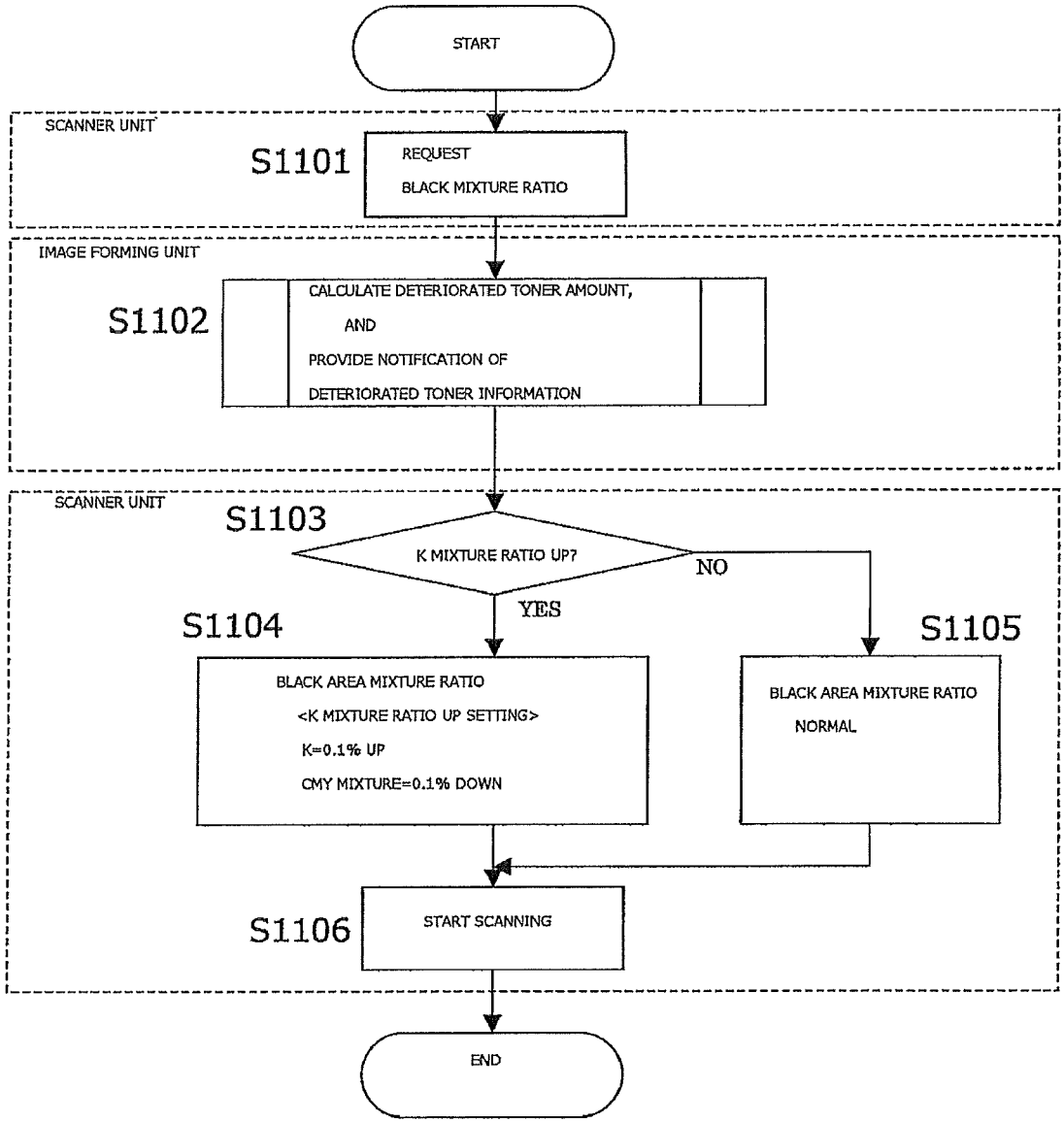
FIG. 11 is a flowchart of a mixture ratio change control before the start of copying processing (second embodiment)

FIG. 11 is a flowchart of a mixture ratio change control before the start of copying processing (second embodiment). FIG. 11 corresponds to FIG. 8 of the first embodiment.

When the centralized controller 101 detects the input of a copying instruction, the scanner controller 103 starts reading processing. At step S1101, the scanner controller 103 requests the deteriorated toner information from the printer controller 102.

Step S1102 is executed by the printer controller 102. When the deteriorated toner information is requested, at step S1102, the printer controller 102 calculates the deteriorated toner amount of each color. Moreover, at step S1102, the printer controller 102 creates deteriorated toner information, and transmits the deteriorated toner information to the scanner controller 103.

Steps S1103 to S1106 are executed by the scanner controller 103. At step S1103, the scanner controller 103 determines whether the deteriorated toner information is "K mixture ratio UP" or not. When the deteriorated toner information is "K mixture ratio UP", step S1104 is executed, and when the deteriorated toner information is "normal", step S1105 is executed. At step S1104, the black area mixture ratio is set to the "K mixture ratio UP setting". At step S1105, the black area mixture ratio is set to the "normal setting". When the black area mixture ratio is set, at step S1106, the scanner controller 103 starts reading processing.

Third Embodiment

Next, the copier 1 of a third embodiment will be described. The third embodiment is the same as the first embodiment except for the following differences: Between these embodiments, the mixture ratio combination and the mixture ratio change condition are different.

In the first and second embodiments, only the K mixture ratio is relatively increased in the mixture ratio change from the "normal setting". On the contrary, in the third embodiment, a case where only the K mixture ratio is relatively increased and a case where only the CMY mixture ratio is relatively increased are provided in the mixture ratio change from the "normal setting".

Figure 12:
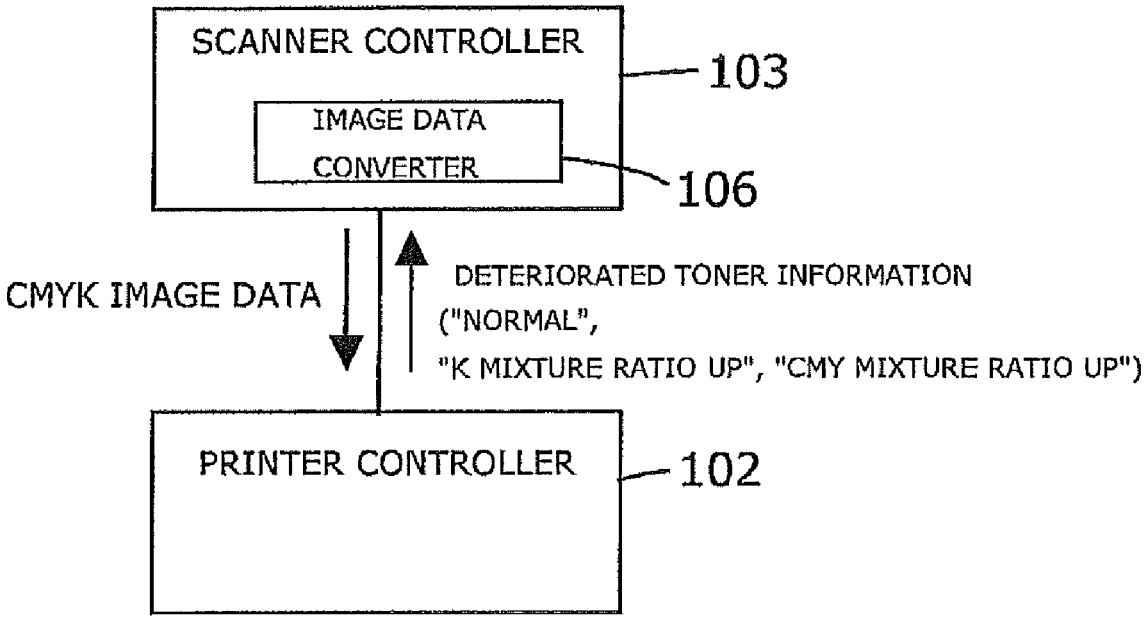
FIG. 12 is a view showing data exchanged between the printer controller 102 and the image data converter 106 (third embodiment)

FIG. 12 is a view showing data exchanged between the printer controller 102 and the image data converter 106 (third embodiment). The apparatus structure of FIG. 12 (third embodiment) is the same as that of FIG. 7 (first embodiment). Between these embodiments, the contents of the deteriorated toner information transmitted from the printer controller 102 to the scanner controller 103 are different.

In the third embodiment, the deteriorated toner information is "normal", "K mixture ratio UP" or "CMY mixture ratio UP setting". The deteriorated toner information is set to "normal", "K mixture ratio UP" or "CMY mixture ratio UP setting" based on the mixture ratio change condition.

The mixture ratio change condition according to the third embodiment includes the K high predetermined value, a K low predetermined value, a CMY high predetermined value and a CMY low predetermined value. The K high predetermined value is 60 mm, the K low predetermined value is 50 mm, the CMY high predetermined value is 60 mm, and the CMY low predetermined value is 50 mm.

The mixture ratio change condition is as follows:

(U1) When a change from "normal" to "K mixture ratio UP" is made or "K mixture ratio UP" is maintained, the K deteriorated toner amount≧60 mm and the color deteriorated toner amount<50 mm.

(U2) When a change from "normal" to "CMY mixture ratio UP" is made or "CMY mixture ratio UP" is maintained, the color deteriorated toner amount≧60 mm and the K deteriorated toner amount<50 mm.

(N) When a change from "K mixture ratio UP" or "CMY mixture ratio UP" to "normal" is made or "normal" is maintained, the K deteriorated toner amount and the color deteriorated toner amount satisfy neither of the relationships (U1) and (U2).

When the relationship (U1) of the mixture ratio change condition is satisfied, the K deteriorated toner amount is relatively larger than the deteriorated toner amounts of C, M and Y. At this time, the printer controller 102 sets the deteriorated toner information to "K mixture ratio UP". In response thereto, the image data converter 106 sets the black area mixture ratio to the "K mixture ratio UP setting". In the present embodiment, as mentioned above, the CMY mixture ratio is set to 29%, and the K mixture ratio is set to 61%.

When the relationship (U1) of the mixture ratio change condition is satisfied, the K deteriorated toner amount is relatively smaller than the deteriorated toner amounts of C, M and Y. At this time, the printer controller 102 sets the deteriorated toner information to "CMY mixture ratio UP". In response thereto, the image data converter 106 sets the black area mixture ratio to the "CMY mixture ratio UP setting". In the "CMY mixture ratio UP setting", the CMY mixture ratio is set to the CMY high mixture ratio, and the K mixture ratio is set to the K low mixture ratio. In an example, the CMY high mixture ratio is 31%, and the K low mixture ratio is 59%. That is, the CMY mixture ratio is increased 1%, and the K mixture ratio is decreased 1%. As described above, the deteriorated toner amounts of C, M and Y can be reduced by increasing the CMY mixture ratio.

On the other hand, when neither of the relationships (U1) and (U2) of the mixture ratio change condition is satisfied, the deteriorated toner information is set to "normal". In "normal", the black area mixture ratio is set to the "normal setting". In the present embodiment, the CMY mixture ratio is set to 30% (CMY reference mixture ratio), and the K mixture ratio is set to 60% (K reference mixture ratio).

Figure 13:
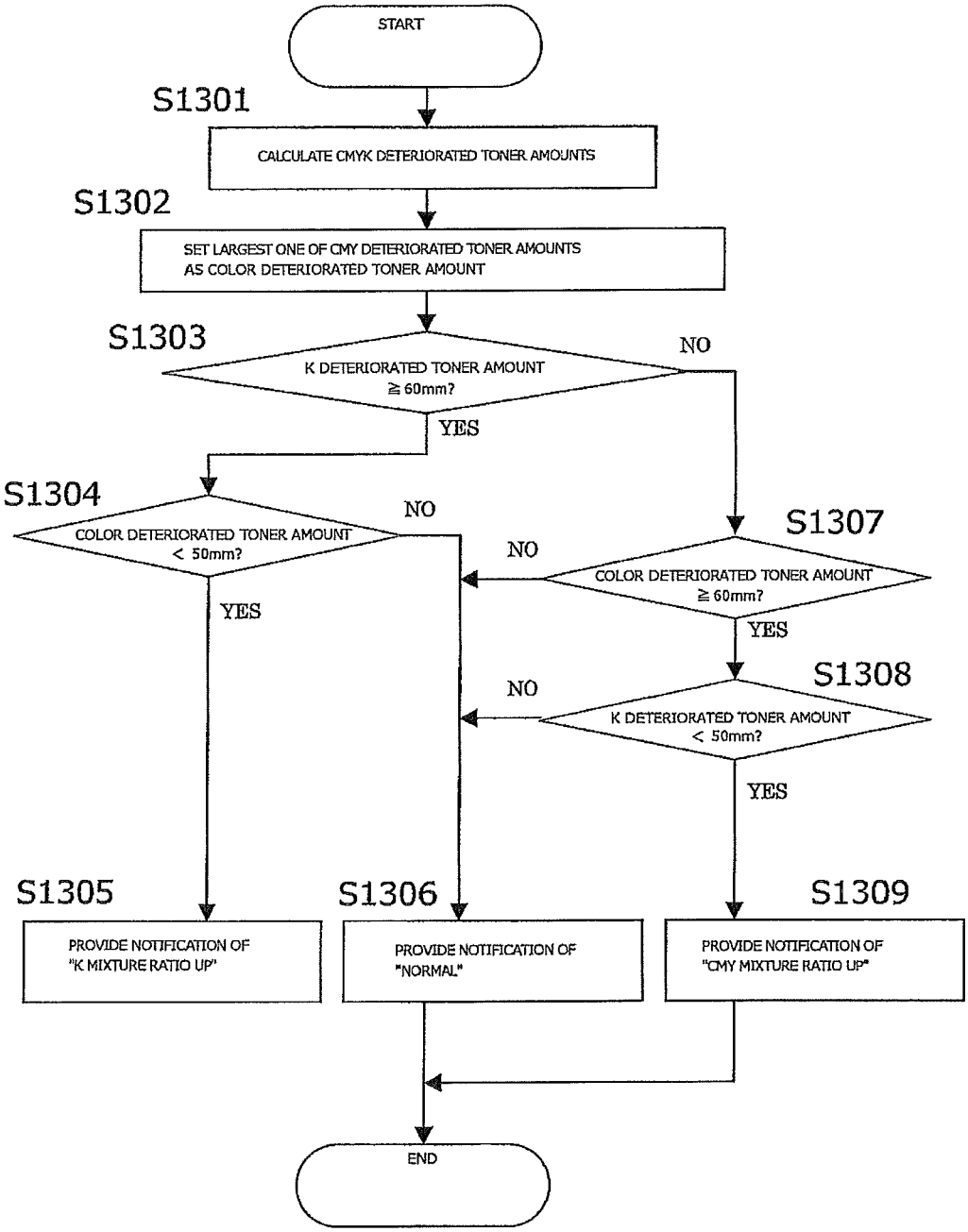
FIG. 13 is a flowchart for setting the deteriorated toner information (third embodiment)

FIG. 13 is a flowchart for setting the deteriorated toner information (third embodiment). First, at step S1301, the printer controller 102 calculates the deteriorated toner amounts of all the colors. Then, at step S1302, the printer controller 102 sets the largest one of the deteriorated toner amounts of C, M and Y as the color deteriorated toner amount. Then, at step S1303, the printer controller 102 determines whether the K deteriorated toner amount is not less than 60 mm or not. When the result of S1303 is YES, at S1304, the printer controller 102 determines whether the color deteriorated toner amount is less than 50 min or not. According to the determination of S1304, the processing is performed as in the case of the second embodiment (FIG. 10). That is, when the result of step S1304 is YES, at step S1305, the printer controller 102 sets the deteriorated toner information to "K mixture ratio UP". When the result of S1304 is NO, at step S1306, the printer controller 102 sets the deteriorated toner information to "normal". The scanner controller 103 is notified of the set deteriorated toner information.

In the third embodiment, when the result of S1303 is NO, that is, when the K deteriorated toner amount is less than 60 mm, the deteriorated toner information is not always set to "normal". At step S1307, the printer controller 102 determines whether the color deteriorated toner amount is not less than 60 mm or not. When the color deteriorated toner amount is not less than 60 mm, at step S1306, the printer controller 102 sets the deteriorated toner information to "normal". When the result of S1307 is YES, at step S1308, the printer controller 102 determines whether the K deteriorated toner amount is less than 50 min or not. When the K deteriorated toner amount is less than 50 mm, at step S1309, the printer controller 102 sets the deteriorated toner information to "CMY mixture ratio UP". In this way, the increase in the deteriorated toner amounts of C, M and Y is suppressed. On the other hand, when the K deteriorated toner amount is less than 50 mm, at step S1306, the printer controller 102 sets the deteriorated toner information to "normal". In this way, the forcible discharge of the K deteriorated toner is prevented from being affected. The scanner controller 103 is notified of the set deteriorated toner information.

Figure 14:
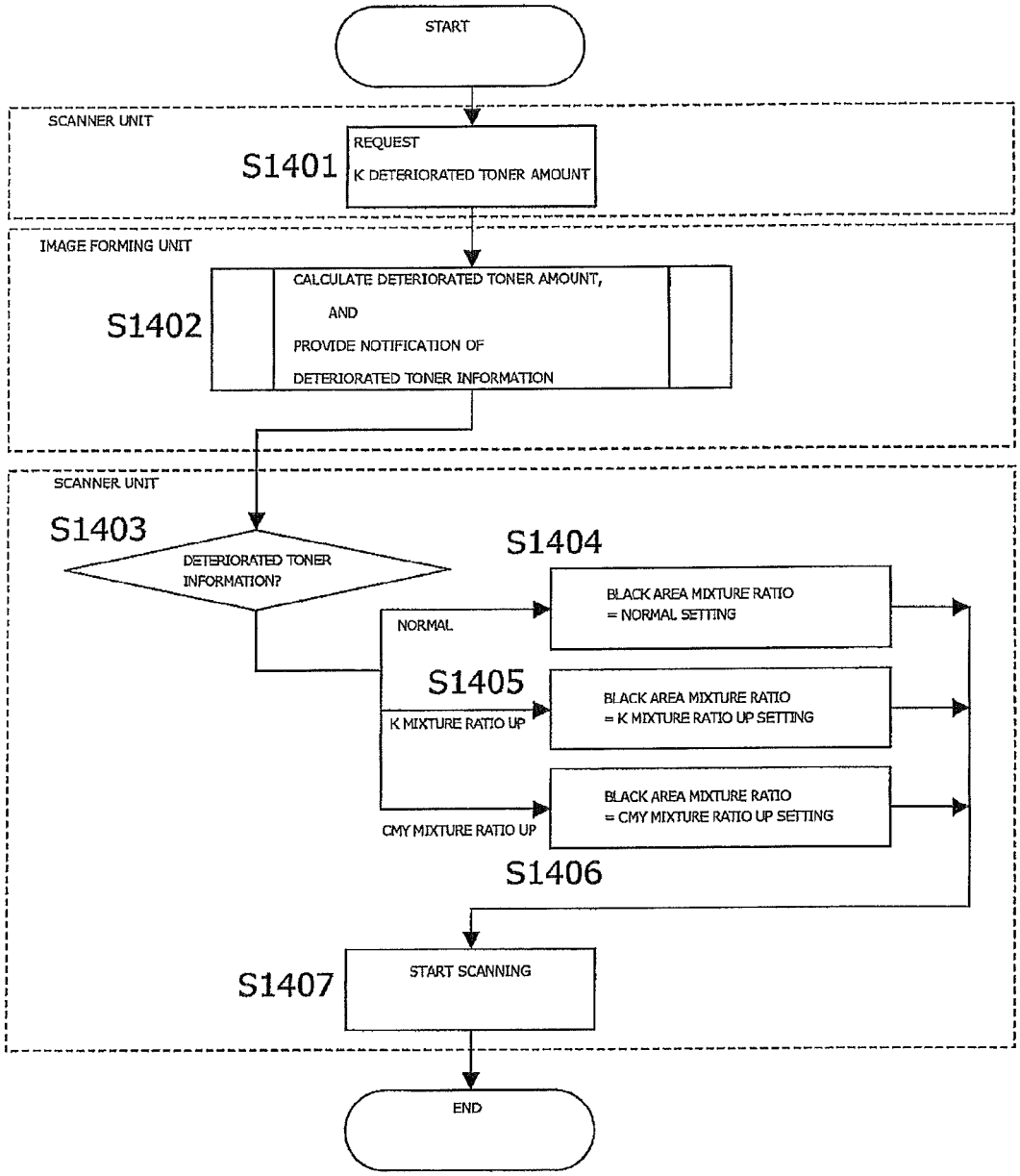
FIG. 14 is a flowchart of a mixture ratio change control before the start of copying processing (third embodiment)

FIG. 14 is a flowchart of a mixture ratio change control before the start of copying processing (third embodiment). FIG. 14 corresponds to FIG. 8 of the first embodiment.

When the centralized controller 101 detects the input of a copying instruction, the scanner controller 103 starts reading processing. At step S1401, the scanner controller 103 requests the deteriorated toner information from the printer controller 102.

Step S1402 is executed by the printer controller 102. When the deteriorated toner information is requested, at step S1402, the printer controller 102 calculates the deteriorated toner amount of each color. Moreover, at step S1402, the printer controller 102 creates deteriorated toner information, and transmits the deteriorated toner information to the scanner controller 103.

Steps S1403 to S1407 are executed by the scanner controller 103. At step S1403, the scanner controller 103 determines whether the deteriorated toner information is "K mixture ratio UP", "CM mixture ratio" or "normal". When the deteriorated toner information is "normal", step S1404 is executed, when the deteriorated toner information is "K mixture ratio UP", step S1405 is executed, and when the deteriorated toner information is "CMY mixture ratio UP", step S1406 is executed. At step S1404, the black area mixture ratio is set to "normal". At step S1405, the black area mixture ratio is set to the "K mixture ratio UP setting". At step S1406, the black area mixture ratio is set to "CMY mixture ratio UP setting". When the black area mixture ratio is set, at step S1407, the scanner controller 103 starts reading processing.

Fourth Embodiment

Next, the copier 1 of a fourth embodiment will be described. The fourth embodiment is the same as the first embodiment except for the differences mentioned below. In the fourth embodiment, the structure for calculating the deteriorated toner amount of each color is provided in the scanner controller 103. For this reason, in the fourth embodiment, the deteriorated toner amount is calculated based on the read image data, and the black area mixture ratio is changed based on the calculated deteriorated toner amount. On the contrary, in the first embodiment, the structure for calculating the deteriorated toner amount of each color is provided in the printer controller 102. For this reason, in the first embodiment, the deteriorated toner amount is calculated based on the driving amount of the developing unit of the printer controller 102, and the black area mixture ratio is changed based on the calculated deteriorated toner amount. As described above, between these two embodiments, the structure associated with the deteriorated toner amount calculation and the control associated with the deteriorate toner amount calculation are different. The control of the forcible discharge of the deteriorated toner is the same between these two embodiments.

Figure 15:
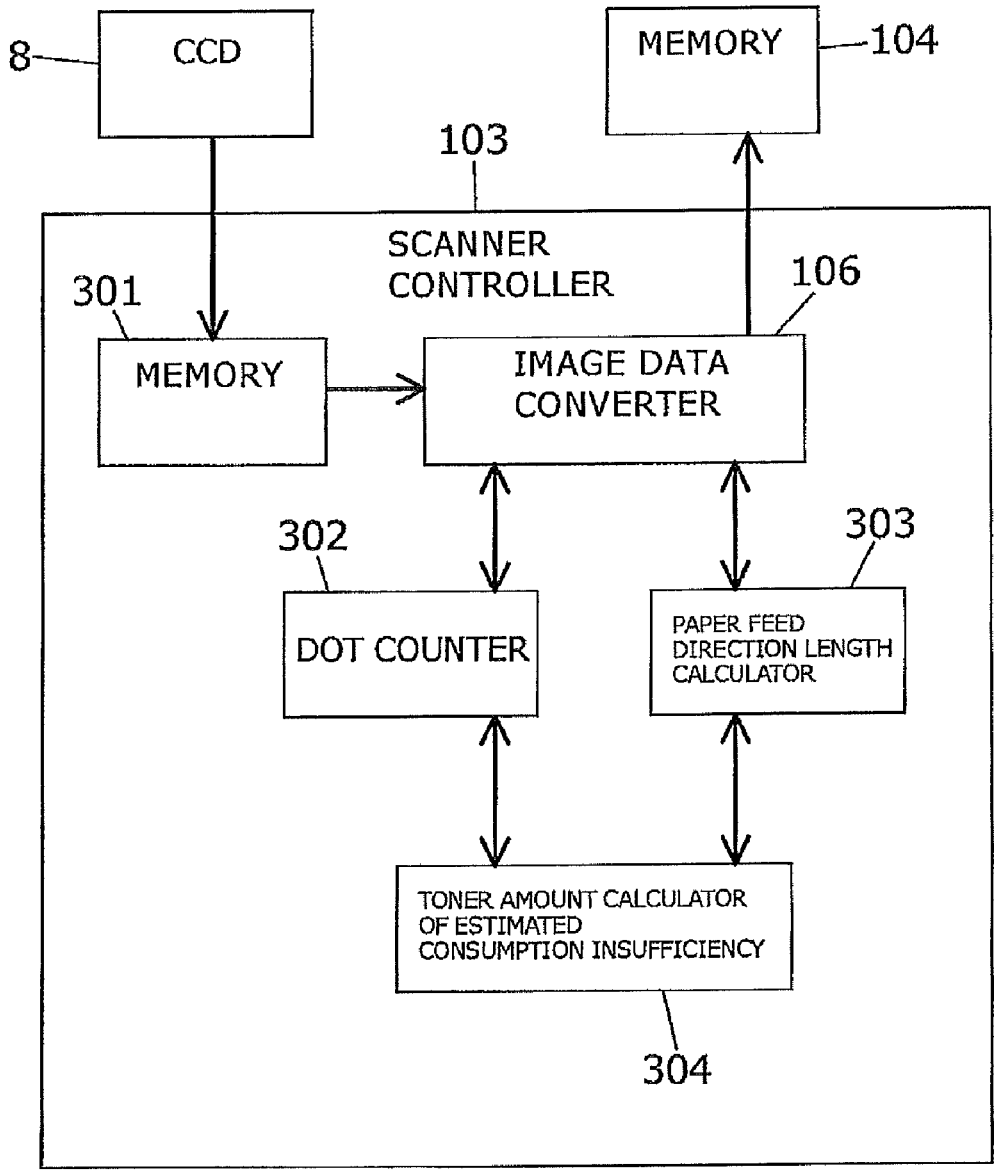
FIG. 15 is a block diagram showing the structure of a scanner controller 103 (fourth embodiment)

FIG. 15 is a block diagram showing the structure of the scanner controller 103 (fourth embodiment). In the fourth embodiment, the scanner controller 103 is provided with the image data converter 106, a memory 301, a dot counter 302, a paper feed direction length calculator 303 and an toner amount calculator 304 of estimated consumption insufficiency.

The memory 301 stores the image data of the RGB system outputted from the CCD 8.

The image data converter 106 converts the image data of the RGB system into image data of the CMYK system as mentioned above.

The dot counter 302 (toner amount calculator of estimated consumption) calculates the number of dots of each of C, M, Y and K included in one piece of image data of the CMYK system. As mentioned above, the number of dots corresponds to the amount of toner. Therefore, the dot counter 302 is capable of calculating the amount of toner (dot) of each of C, M, Y and K necessary for printing one piece of image data of the CMYK system.

The paper feed direction length calculator 303 (driving amount calculator) calculates, based on one piece of image data of the CMYK system, the length (dot) in the paper feed direction in the image data. In the image data, dots are arranged in a two-dimensional arrangement in the paper feed direction and in the width direction. Therefore, the number of dots corresponding to the overall length in the paper feed direction in the image data can be calculated. By multiplying the number of dots (dot) in the paper feed direction by the resolution (dot/mm), the length (mm) in the paper feed direction is calculated. Hereinafter, the number of dots in the paper feed direction will be expressed as the paper feed direction length (dot). Here, the length (dot) is a value that is set with the dot as the unit.

The paper feed direction length (dot) provides the driving amount of the developing unit when one piece of image data of the CMYK system is printed. The speed of paper feeding by the conveying unit 7, the speed of movement of the photoreceptor and the speed of stirring in the developing unit are fixed. For this reason, a predetermined relationship holds between the driving time of the developing unit and the paper feed direction length. Therefore, the driving time and the stirring speed of the developing unit can be identified based on the paper feed direction length (dot).

The paper feed direction length calculator 303 (C, M, Y and K toner amount calculators of the necessary consumption) further calculates the toner amount of the necessary consumption of each color based on the paper feed direction length (dot). The toner amount of the necessary consumption of C is the amount of C toner to be consumed to prevent C toner from deteriorating while the developing unit 24C is driven for a predetermined driving time. This applies to the other colors. The toner amount of the necessary consumption of each color is calculated by expressions (6) and (6a).

The toner amount of the necessary consumption (dot)=the number of dots of a predetermined size×(the paper feed direction length (dot)/the number of dots of a predetermined length) (6)

The toner amount of the necessary consumption (dot)=1600000×(the paper feed direction length (dot)/7000) (6a)

Here, the number of dots of a predetermined size refers to the number of all the dots included in a sheet of the predetermined size when printing onto the sheet is performed with a predetermined resolution. Moreover, the number of dots of a predetermined length refers to the number of dots corresponding to the overall length of the sheet of the predetermined size in the paper feed direction. In the present embodiment, the number of dots of a predetermined size is set in a case where printing is performed onto an A4 longitudinal size sheet at 600 dpi (dot/inch) and at a density of 5%. That is, this is similar to the example in the first embodiment. Therefore, the number of dots of a predetermined size is 1600000 dots. Moreover, in the present embodiment, the number of dots of a predetermined length is the number of dots corresponding to the overall length of an A4 longitudinal size sheet in the paper feed direction. Therefore, the number of dots of a predetermined length is approximately 7000 dots. Approximately 7000=29.7 (cm)×(600/2.54).

The paper feed direction length can be calculated by using mm as the unit. In this case, the toner amount of the necessary consumption of each color is calculated by expressions (7) and (7a).

The toner amount of the necessary consumption (dot)=the number of dots of a predetermined size×(the paper feed direction length (mm)/the number of dots of a predetermined length) (7)

The toner amount of the necessary consumption (dot)=1600000×(the paper feed direction length (mm)/297) (7a)

For example, in the case of a letter-size longitudinal image, the toner amount of the necessary consumption (dot) is approximately 1505000 dots. Approximately 1505000 dots=1600000 dots×279.4 mm/297 mm.

For each of C, M, Y and K, the toner amount calculator 304 of the estimated consumption insufficiency (C, M, Y and K toner amount calculators of estimated consumption insufficiency) calculates a toner amount of estimated consumption insufficiency of each color by subtracting the toner amount of the estimated consumption of each color from the toner amount of the necessary consumption of each color. The relationship among these toner amounts is an expression (8).

The toner amount of the estimated consumption insufficiency=the toner amount of the necessary consumption−the toner amount of the estimated consumption of each color (8)

The toner amount calculator 304 of the estimated consumption insufficiency have the same function as the toner amount calculator 204 of the consumption insufficiency in the first to third embodiments. The toner amount of the necessary consumption, the toner amount of the estimated consumption and the toner amount of the estimated consumption insufficiency in the fourth embodiment correspond to the toner amount of the necessary consumption, the toner amount of the cumulative consumption and the toner amount of the consumption insufficiency of the first embodiment, respectively.

In the first to third embodiments, the CMY mixture ratio and the K mixture ratio for expressing black are set according to the deteriorated toner accumulation amount. That is, the mixture ratio in the future printing is changed or maintained based on the result of the already finished printing. On the other hand, in the fourth embodiment, the CMY mixture ratio and the K mixture ratio are set based on the image data printed this time. That is, the mixture ratio for the present printing is changed or maintained prior to printing. Hereinafter, the control in the fourth embodiment will be described in detail.

Figure 16:
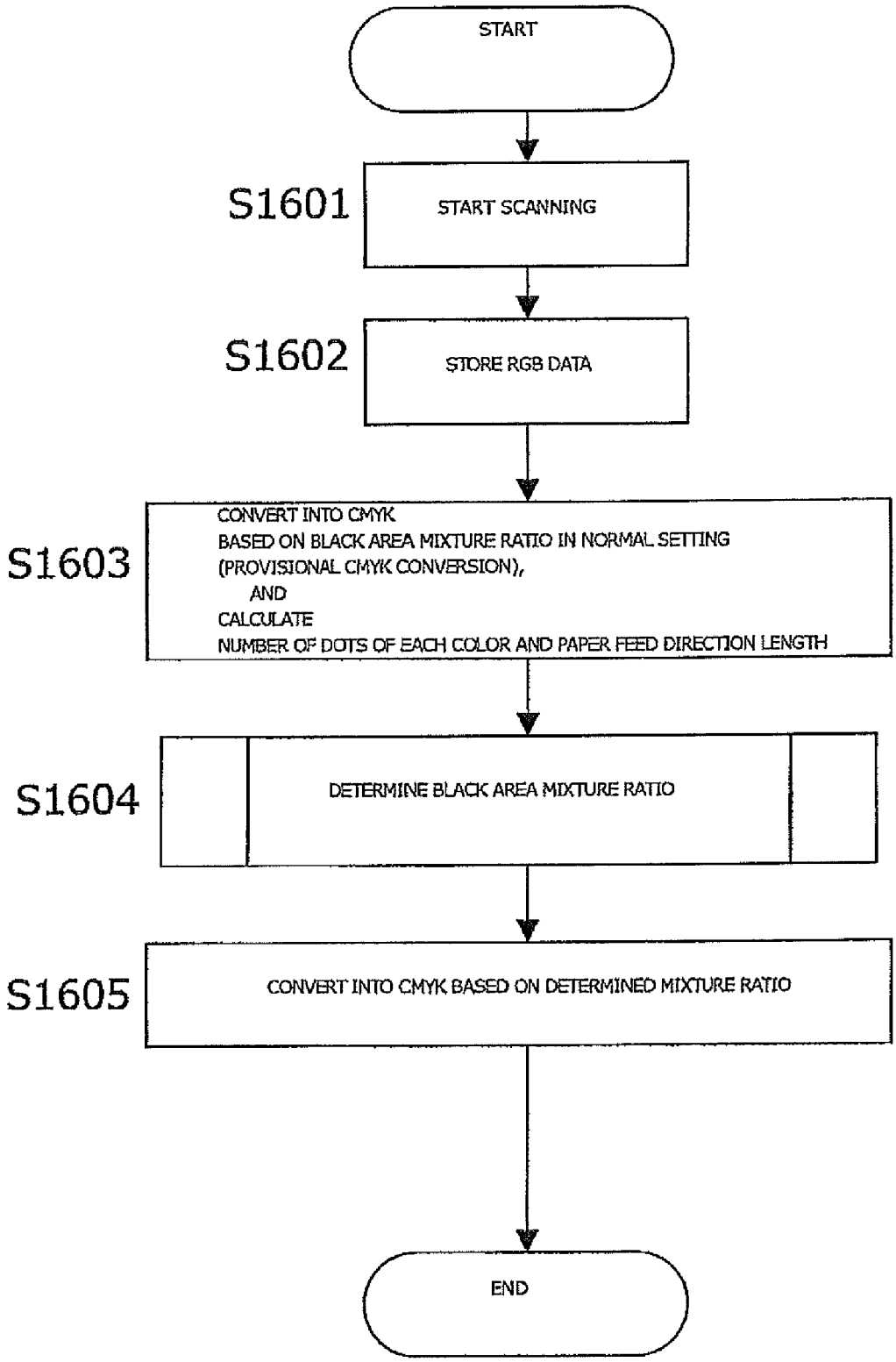
FIG. 16 is a flowchart of the conversion processing of creating image data of the CMYK system (fourth embodiment)

FIG. 16 is a flowchart of the conversion processing of creating image data of the CMYK system (fourth embodiment). First, at step S1601, the scanner controller 103 reads the image of the original. Then, at step S1602, the scanner controller 103 stores the read image data of the RGB system into the memory 301. Then, at S1603, the image data of the RGB system is provisionally converted into image data of the CMYK system based on the black area mixture ratio in the "normal setting". At step S1603, the toner amount (dot) of each color and the paper feed direction length (dot) are calculated for the provisionally converted image data of the CMYK system. Then, at step S1604, the black area mixture ratio in the present printing is determined based on the toner amount (dot) of each color and the paper feed direction length (dot). Details of step S1604 will be described later by using FIG. 17. Then, at step S1605, the image data of the RGB system is, again, actually converted into image data of the CMYK system based on the determined black area mixture ratio. The word "actually" is used for distinction from "provisional". The actually converted image data of the CMYK system is transmitted to the external memory 104. Needless to say, the provisionally converted image data of the CMYK system is not transmitted to the memory 104.

In the flow of FIG. 16, the image data of the RGB system is converted at both steps S1603 and S1605. Since conversion is performed twice, the scanner controller 103 is provided with the memory 301 for storing the image data of the RGB system.

In the present embodiment, reading by the CCD 8 is performed once, and conversion is executed twice based on the read one piece of image data of the RGB system. For this reason, the memory 301 is required. It may be performed to execute reading by the CCD 8 twice and execute conversion every reading. In this structure, the provisional conversion is performed in the first reading, and the actual conversion is performed in the second reading. In this case, the memory 301 is unnecessary.

Figure 17:
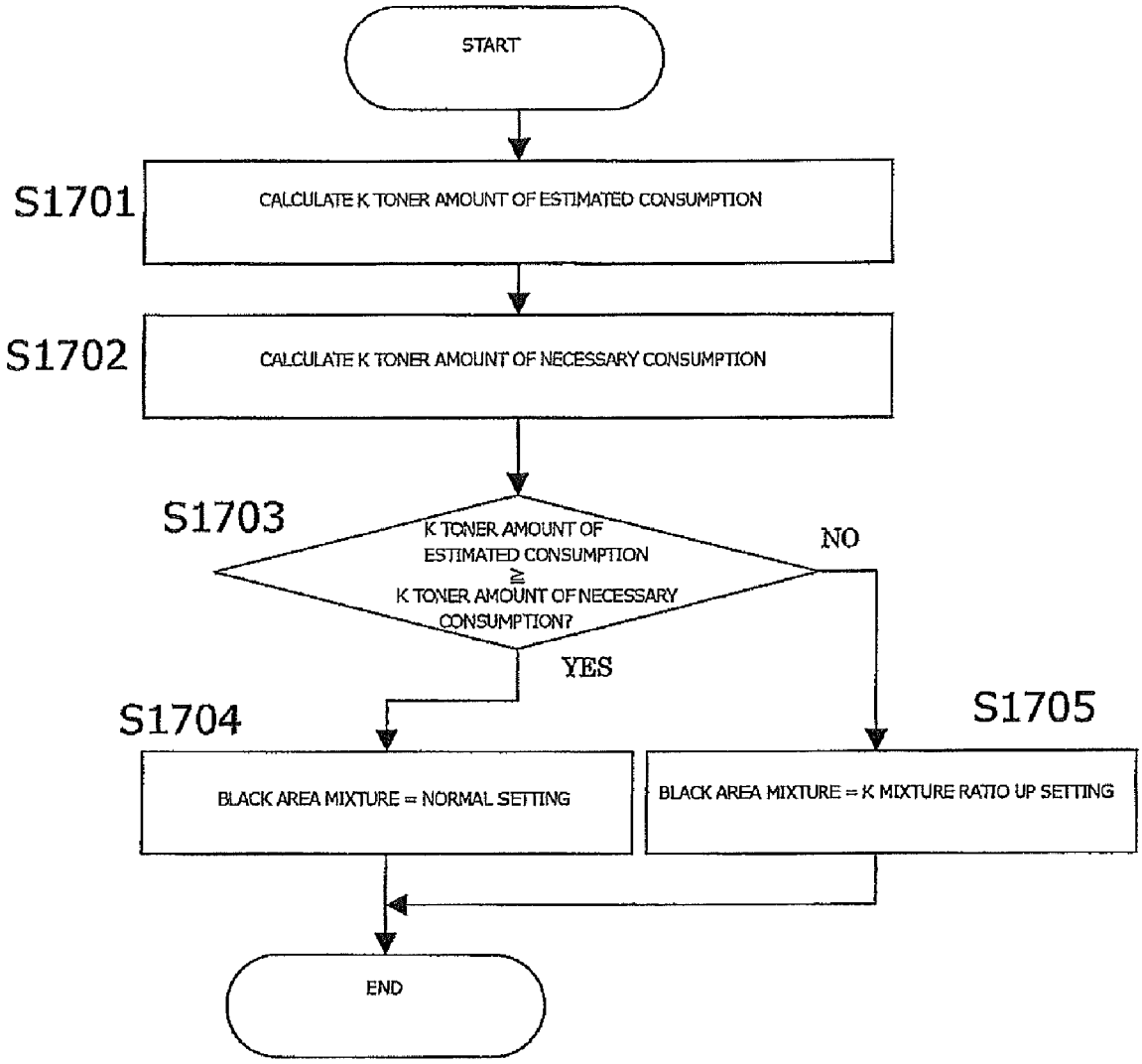
FIG. 17 is a flowchart of a mixture ratio change control (fourth embodiment)

FIG. 17 is a flowchart of the mixture ratio change control (fourth embodiment). FIG. 17 shows, in detail, step S1604 of FIG. 16 which is a subroutine. First, at step S1701, the dot counter 302 calculates the K toner amount of the estimated consumption. Then, at step S1702, the paper feed direction length calculator 303 calculates the K toner amount of the necessary consumption. Then, at step S1703, the scanner controller 103 determines whether the K toner amount of the estimated consumption is not less than the K toner amount of the necessary consumption or not. When the result of step S1703 is YES, at step S1704, the image data converter 106 sets the CMY mixture ratio and the K mixture ratio to the "normal setting". When the result of step S1703 is NO, at step S1705, the image data converter 106 sets the CMY mixture ratio and the K mixture ratio to the "K mixture ratio UP setting".

Fifth Embodiment

Next, the copier 1 of a fifth embodiment will be described. The fifth embodiment is the same as the fourth embodiment except for the following difference: In the fifth embodiment, the dot counter 302 is not provided in the scanner controller 103. For this reason, the fifth embodiment uses the dot counter 200 in the centralized controller 101 to perform a similar mixture ratio change control to that of the fourth embodiment.

Figure 18:
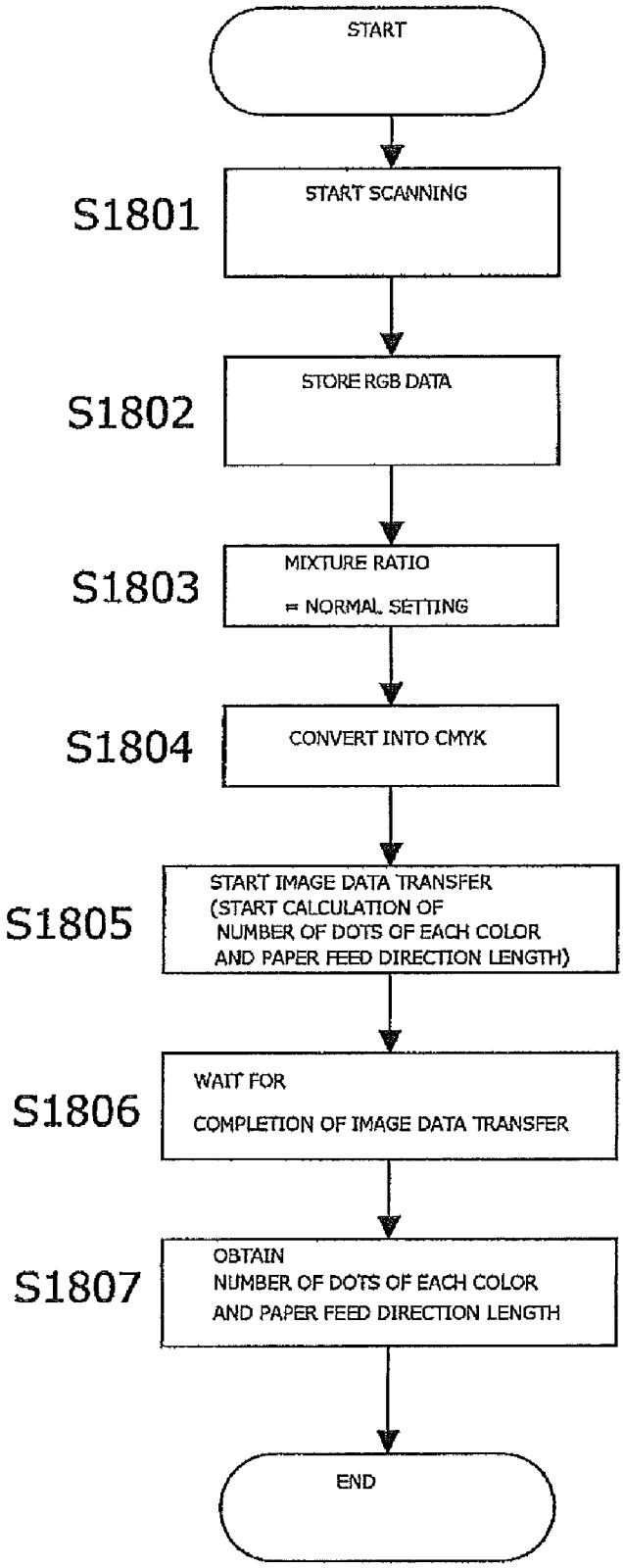
FIG. 18 is a flowchart of the conversion processing of creating provisionally converted image data of the CMYK system (fifth embodiment)

FIG. 18 is a flowchart of the conversion processing of creating the provisionally converted image data of the CMYK system (fifth embodiment). The flow of FIG. 18 and the flow from step S1604 on of FIG. 16 are united to complete the flow of the conversion processing of creating the image data of the CMYK system.

First, at step S1801, the scanner controller 103 reads the image of the original. Then, at step S1802, the scanner controller 103 stores the read image data of the RGB system into the memory 301. Then, at S1803, the black area mixture ratio is set to the "normal setting". Then, at S1804, the image data of the RGB system is provisionally converted into image data of the CMYK system based on the black area mixture ratio in the "normal setting". Then, at S1805, the transfer of the provisionally converted image data of the CMYK system is started. The destination of the transfer is the external memory 104. At this time, the dot counter 200 in the centralized controller 101 starts the calculation of the toner amount (dot) of each color and the paper feed direction length (dot). The dot counter 200 is capable of calculating the paper feed direction length (dot). Then, at step S1806, the scanner controller 103 waits for the completion of the image data transfer. When the transfer is completed, the dot counter 200 completes the calculation of the toner amount (dot) of each color and the paper feed direction length (dot). When the transfer is completed, the process proceeds to step S1806. At step S1807, the scanner controller 103 obtains the toner amount (dot) of each color and the paper feed direction length (dot) from the dot counter 200.

When step S1807 of FIG. 18 is finished, the process proceeds to step S1604 of FIG. 16. At step S1604, the black area mixture ratio in the present printing is determined based on the toner amount (dot) of each color and the paper feed direction length. The details of step S1604 correspond to FIG. 17. Then, at step S1605, the image data of the RGB system is, again, actually converted into image data of the CMYK system based on the determined black area mixture ratio. The actually converted image data of the CMYK system is again transmitted to the external memory 104. The provisionally converted image data of the CMYK system is deleted from the inside of the memory 104 after step S1807 is finished.

In the above description, in the fifth embodiment, provisional conversion for obtaining information for mixture ratio change is executed prior to printing processing for one sheet, and thereafter, conversion for printing processing is executed. The information for mixture ratio change refers to the toner amount (dot) of each color and the paper feed direction length (dot) obtained from one piece of image data of the CMYK system. To printing processing onto a plurality of sheets, a procedure (second procedure) described below is applicable instead of the above-described procedure (first procedure). In the second procedure, in the fifth embodiment, the information for mixture ratio change is obtained in printing processing onto the first sheet, and the mixture ratio is changed for printing processing onto the second and succeeding sheets based on the obtained information for mixture ratio change.

Figure 19:
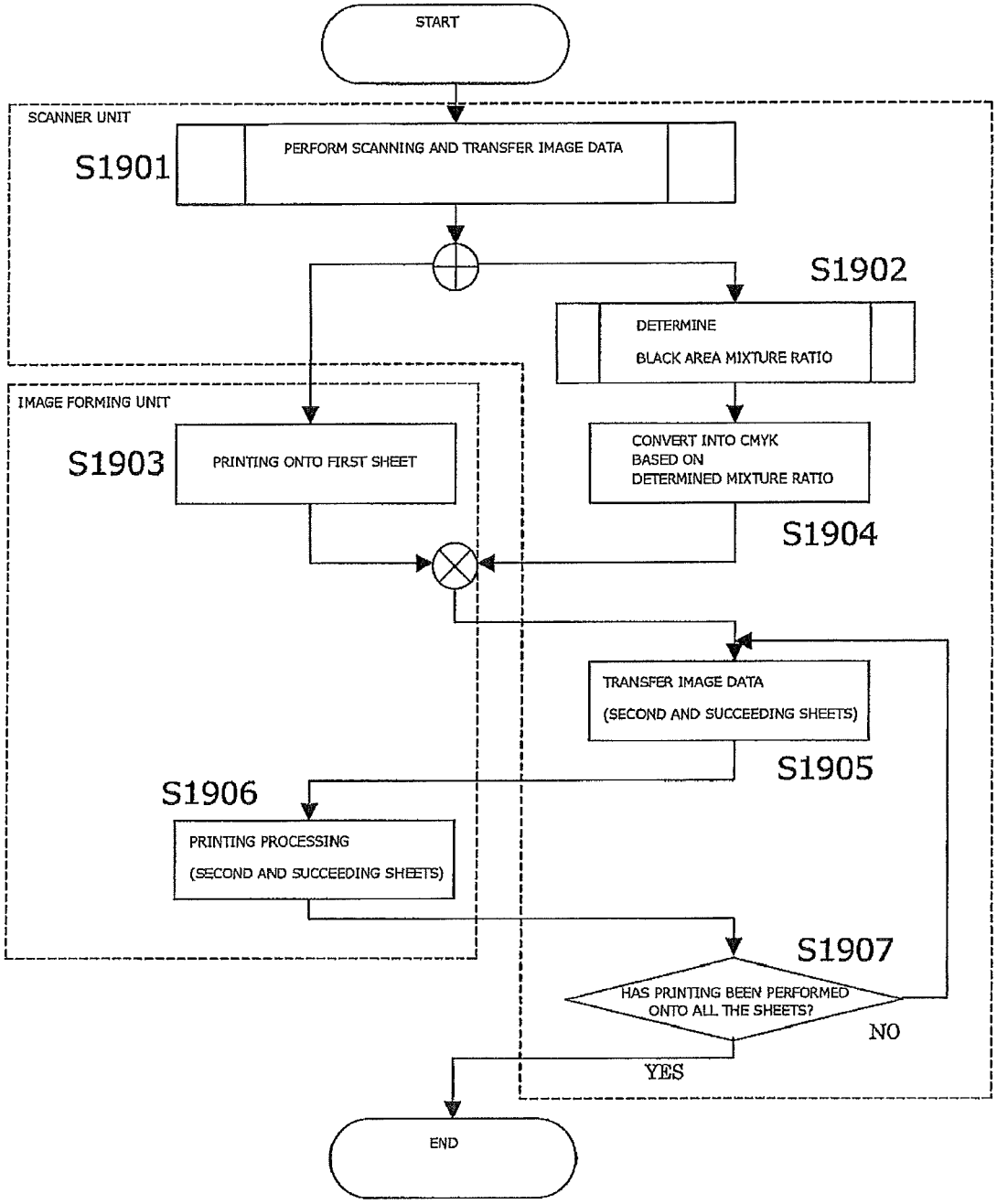
FIG. 19 is a flowchart of copying processing onto a plurality of sheets including the mixture ratio change control (fifth embodiment)

FIG. 19 is a flowchart of copying processing onto a plurality of sheets including the mixture ratio change control (fifth embodiment). First, at step S1901, the scanner controller 103 reads the image of the original, and transmits the converted image data of the CMYK system to the memory 104. Step S1901 is normal reading processing not involving processing such as the provisional conversion. When step S1901 is finished, steps S1902 and S1903 are executed in parallel.

At step S1902, the black area mixture ratio is determined. Step S1902 corresponds to step S1604 (FIG. 16), and is a subroutine (the flow of FIG. 17). Then, at step S1904, the image data of the RGB system is again converted into image data of the CMYK system based on the determined black area mixture ratio. Step S1904 corresponds to step S1604 (FIG. 16). On the other hand, at step S1903, printing processing onto the first sheet is executed.

When step S1903 is finished, step S1906 is started. When step S1906 is started, step S1904 has also been finished. At step S1906, the scanner controller 103 transmits the image data of the CMYK system converted at step S1904, to the memory 104. Then, at step S1906, printing processing is executed. At step S1907, whether printing has been performed onto all the sheets or not is determined. The number of all the sheets is the number of sheets specified by the printing instruction. Steps S1905 and S1906 are repeated as long as printing onto all the sheets is not finished. When printing onto all the sheets is finished, the flow is ended.

In the flow of the second procedure of FIG. 19, there are cases where the mixture ratio for the first sheet and the mixture ratio for the second and succeeding sheets are different. Since the difference between the "normal setting" and the "K mixture ratio UP setting" is small, the density change is a change to an extent that the user does not readily notice.

Sixth Embodiment

Next, the copier 1 of a sixth embodiment will be described. The sixth embodiment is the same as the fourth embodiment except for the mixture ratio change condition. The mixture ratio change condition of the sixth embodiment is the same as that of the second embodiment. That is, the mixture ratio change control of the sixth embodiment considers the influence of C, M and Y.

Figure 20:
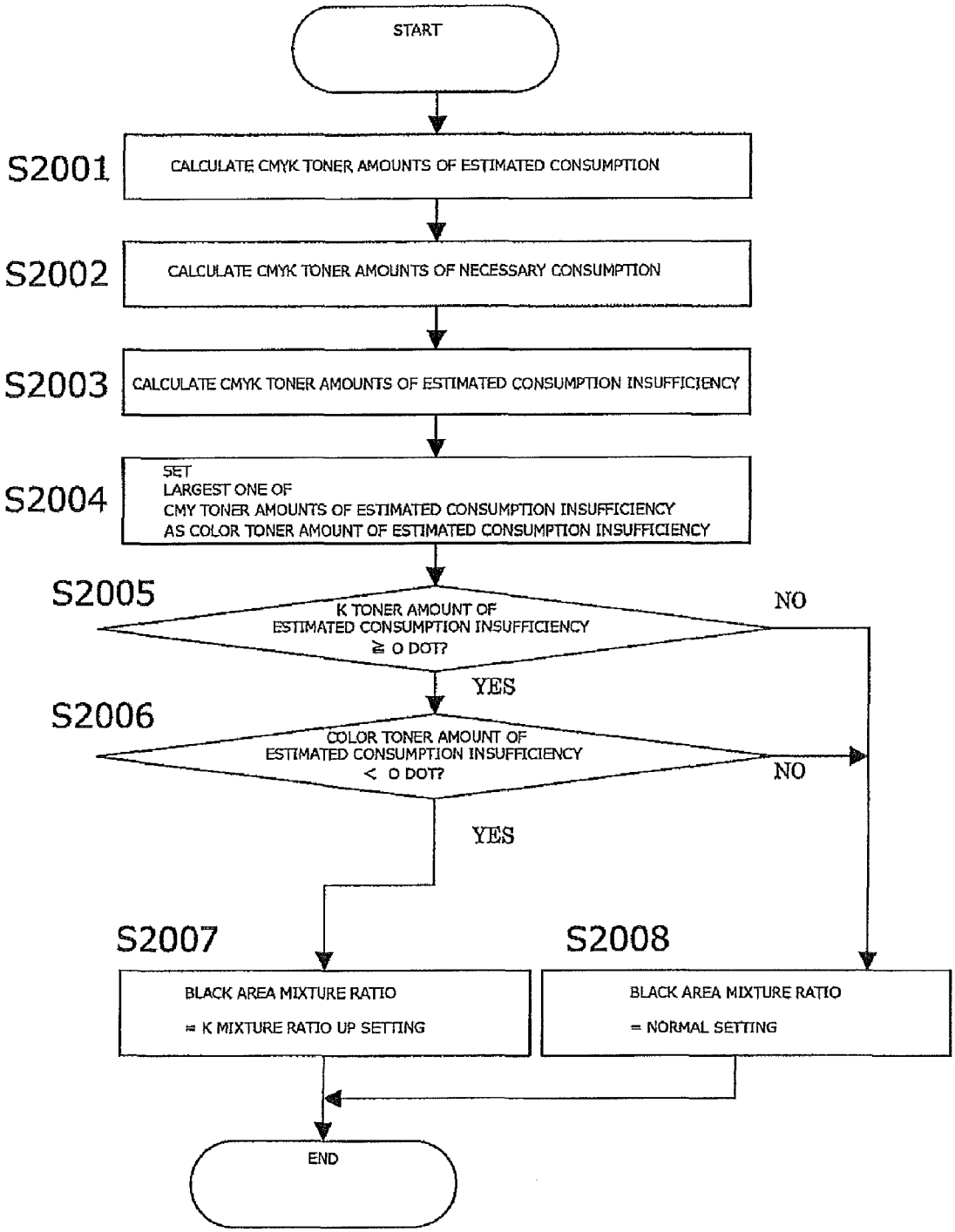
FIG. 20 is a flowchart of a mixture ratio change control (sixth embodiment)

FIG. 20 is a flowchart of a mixture ratio change control (sixth embodiment). FIG. 20 corresponds to FIG. 17 of the fourth embodiment. Therefore, FIG. 20 shows, in detail, step S1604 of FIG. 16 which is a subroutine.

First, at step S2001, for C, M, Y and K, the dot counter 302 calculates the toner amount of the estimated consumption of each color. Then, at step S2002, the paper feed direction length calculator 303 calculates the toner amount of the necessary consumption of each color. Then, at step S2003, the toner amount calculator 304 of the estimated consumption insufficiency calculates the toner amount of the estimated consumption insufficiency of each color. Then, at step S2004, the scanner controller 103 sets the largest one of the toner amounts of the estimated consumption insufficiency of C, M and Y as the color toner amount of the estimated consumption insufficiency.

Then, at step S2005, the scanner controller 103 determines whether the K toner amount of the estimated consumption insufficiency is not less than 0 or not. At step S2006, the scanner controller 103 determines whether the color toner amount of the estimated consumption insufficiency is less than 0 or not.

When the results of steps S2005 and S2006 are both YES, the process proceeds to step S2007. At this time, K toner is insufficiently consumed, and C, Y and M toners are not insufficiently consumed. At step S2007, the CMY mixture ratio and the K mixture ratio are set to the "K mixture ratio UP setting". When the result of at least one of steps S2005 and S2006 is NO, the process proceeds to step S2008. At step S2007, the DMY mixture ratio and the K mixture ratio are set to the "normal setting".

Seventh Embodiment

Next, the copier 1 of a seventh embodiment will be described. The seventh embodiment is the same as the fourth embodiment except for the mixture ratio change condition. The mixture ratio change condition of the seventh embodiment is the same as that of the third embodiment. That is, the mixture ratio change control of the seventh embodiment considers the influence of C, M and Y.

Figure 21:
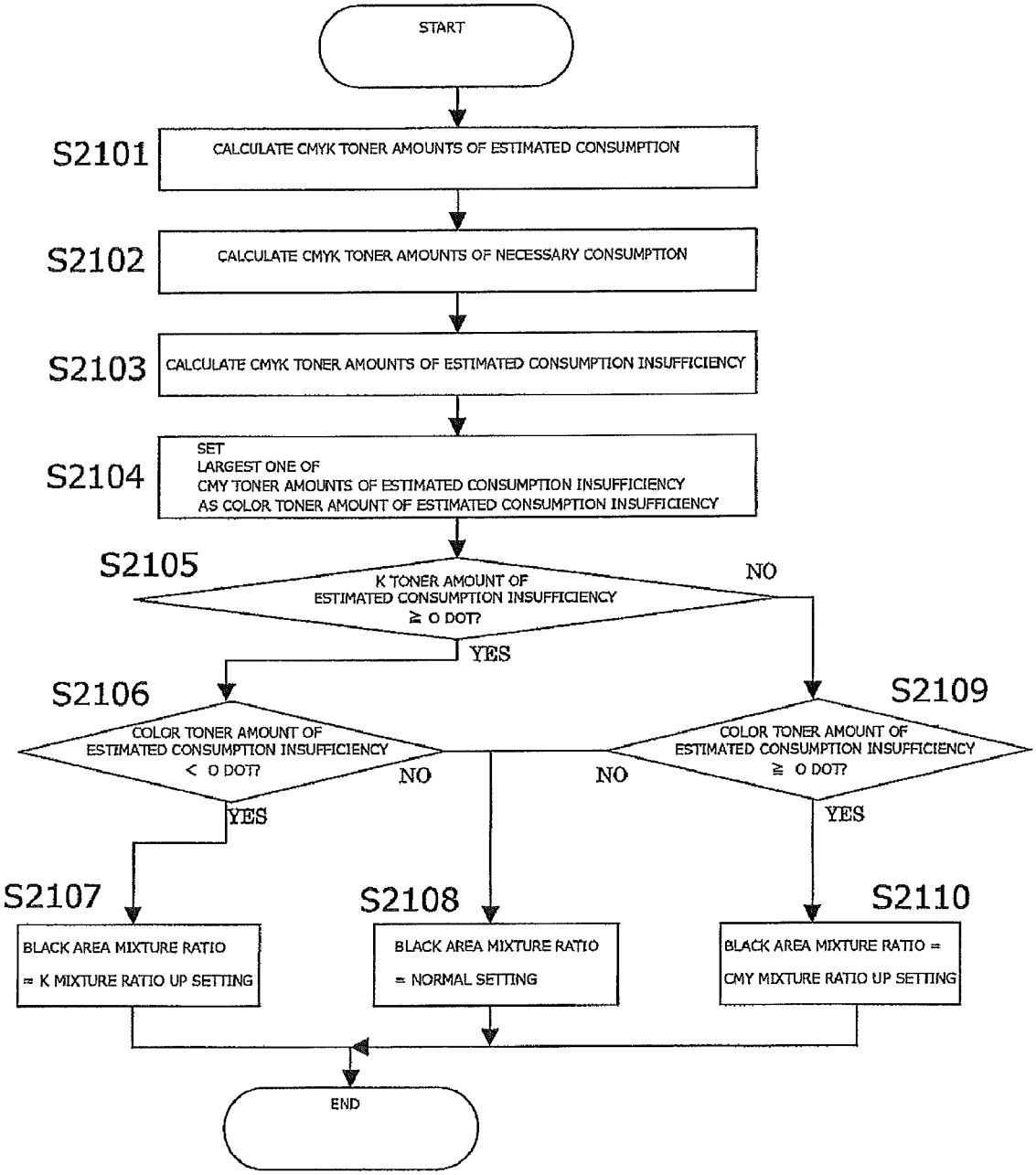
FIG. 21 is a flowchart of a mixture ratio change control (seventh embodiment)

FIG. 21 is a flowchart of a mixture ratio change control (seventh embodiment). FIG. 21 corresponds to FIG. 17 of the fourth embodiment. Therefore, FIG. 21 shows, in detail, step S1604 of FIG. 16 which is a subroutine.

First, at step S2101, for C, M, Y and K, the dot counter 302 calculates the toner amount of the estimated consumption of each color. Then, at step S2102, the paper feed direction length calculator 303 calculates the toner amount of the necessary consumption of each color. Then, at step S2103, the toner amount calculator 304 of the estimated consumption insufficiency calculates the toner amount of the estimated consumption insufficiency of each color. Then, at step S2104, the scanner controller 103 sets the largest one of the toner amounts of the estimated consumption insufficiency of C, M and Y as the color toner amount of the estimated consumption insufficiency.

Then, at step S2105, the scanner controller 103 determines whether the K toner amount of the estimated consumption insufficiency is not less than 0 or not. When the result of step S2105 is YES, at step S2106, the scanner controller 103 determines whether the color toner amount of the estimated consumption insufficiency is less than 0 or not. When the result of step S2105 is NO, at step S2109, the scanner controller 103 determines whether the color toner amount of the estimated consumption insufficiency is not less than 0 or not.

When the results of steps S2105 and S2106 are both YES, the process proceeds to step S2107. At this time, K toner is insufficiently consumed, and C, Y and M toners are not insufficiently consumed. At step S2107, the CMY mixture ratio and the K mixture ratio are set as the "K mixture ratio UP setting". When the result of step S2105 is NO and the result of step S2109 is YES, the process proceeds to step S2110. At this time, K toner is not insufficiently consumed, and C, Y and M toners are insufficiently consumed. At step S2110, the CMY mixture ratio and the K mixture ratio are set to the "CMY mixture ratio UP setting". When the results of the determinations of steps S2105 and S2106 are other than the above-mentioned one, the process proceeds to step S2108. At step S2110, the CMY mixture ratio and the K mixture ratio are set as the "normal setting".

Eighth Embodiment

Next, the copier 1 of an eighth embodiment will be described. The eighth embodiment is the same as the first embodiment except for the operation in continuous printing. In the eighth embodiment, when the same image data is printed onto a plurality of sheets, even if the deteriorated toner amount is changed in continuous printing, the image data converter 106 does not change the CMY mixture ratio or the K mixture ratio.

The centralized controller 101 (copy count detection means) is capable of detecting the copy count specified by the printing instruction.

Figure 22:
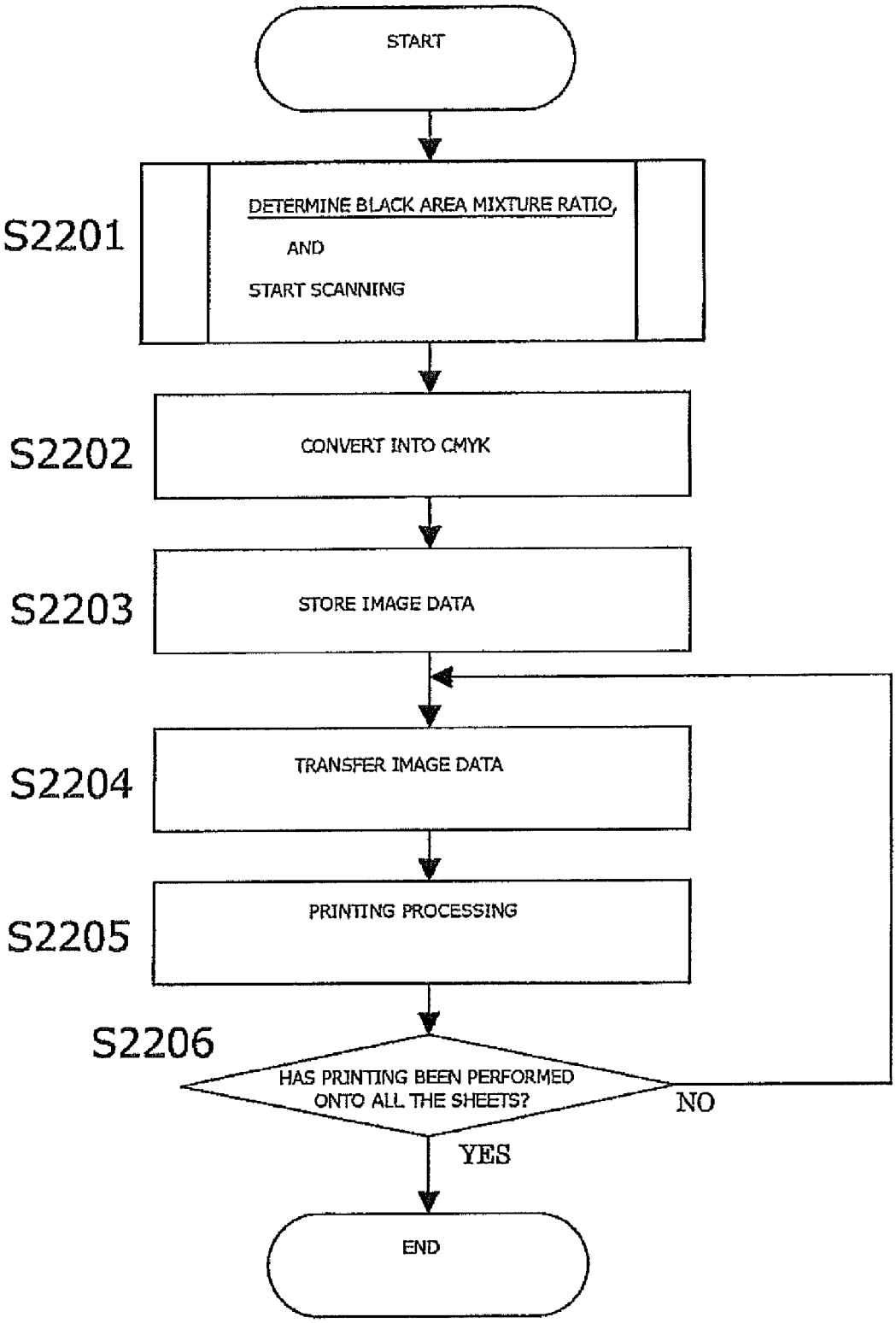
FIG. 22 is a flowchart of copying processing onto a plurality of sheets (eighth embodiment)

FIG. 22 is a flowchart of copying processing onto a plurality of sheets (eighth embodiment). First, at step S2201, the black area mixture ratio is determined, and the reading of the image of the original is started. The determination of the black area mixture ratio is made based on the deteriorated toner amount similarly to the flow of FIG. 6. Then, at step S2202, the image data of the RGB system is converted to the image data of the CMYK system based on the determined black area mixture ratio. Then, at step S2203, the image data of the CMYK system is stored in the memory 104. Then, at step S2204, the image data of the CMYK system is transferred from the memory 104 to the scanner controller 103. Then, at step S2205, printing processing for one sheet is executed. At step S2206, whether printing has been performed onto all the sheets or not is determined. The number of all the sheets is the number of sheets specified by the printing instruction. Steps S2204 and S2205 are repeated as long as printing onto all the sheets is not finished. When printing onto all the sheets is finished, the flow is ended.

In the flow of FIG. 22, the black area mixture ratio is not changed between a plurality of copies where the same image data is printed. For this reason, even when the mixture ratio change is large to an extent that the user can recognize the color difference, no color difference occurs between a plurality of copies where the same image data is printed.

Ninth Embodiment

Next, the copier 1 of a ninth embodiment will be described. The ninth embodiment is the same as the first embodiment except for the contents of the mixture ratio setting in a toner save mode.

The ninth embodiment is provided with a normal mode and the toner save mode as modes associated with toner consumption. In the toner save mode, the overall density of the image is lower than normal in order to suppress toner consumption. For all the dots included in the image data of the CMYK system, the densities thereof in the toner save mode are decreased a predetermined ratio from those in the normal mode. In the present embodiment, the predetermined ratio is 10%. The mode in the first to eighth embodiments is the normal mode.

The centralized controller 101 (mode selector) selects either the normal mode or the toner save mode as the mode of the image data converter 106 based on the user's operation input.

In the ninth embodiment, the contents of the black area mixture ratio setting in the toner save mode are different from those in the normal mode.

In the normal mode, as described above, the black area mixture ratio is set as follows according to the deteriorated toner information: When the deteriorated toner information is "normal", the K mixture ratio and the CMY mixture ratio are set to 60% (K reference mixture ratio) and 30% (CMY reference mixture ratio), respectively. When the deteriorated toner information is "K deteriorated toner amount large", the K mixture ratio and the CMY mixture ratio are set to 61% (K high mixture ratio) and 29% (CMY low mixture ratio), respectively.

On the other hand, in the toner save mode, the black area mixture ratio is set as follows according to the deteriorated toner information:

When the deteriorated toner information is "normal", the K mixture ratio and the CMY mixture ratio are set, first, to 60% (K reference mixture ratio) and 30% (CMY reference mixture ratio), respectively. This is similar to the case of the normal mode. That is, the black area mixture ratio itself is not changed. However, since the mode is the toner save mode, the density itself of each dot of each color is uniformly decreased 10% (predetermined ratio). Therefore, the K mixture ratio and the CMY mixture ratio are set, finally, to 50% (10% cut) and 20% (10% cut), respectively.

When the deteriorated toner information is "K deteriorated toner amount large", the K mixture ratio and the CMY mixture ratio are set, first, to 70% and 30% (CMY reference mixture ratio), respectively. The K mixture ratio 70% is a value obtained by adding the predetermined ratio 10% to the K reference mixture ratio 60%. When the influence of the toner save mode is added, the K mixture ratio and the CMY mixture ratio are set, finally, to 60% (no cut) and 20% (10% cut). As described above, by adding a predetermined ratio to the K mixture ratio, the influence of the density reduction in the toner save mode is canceled out.

Figure 23:
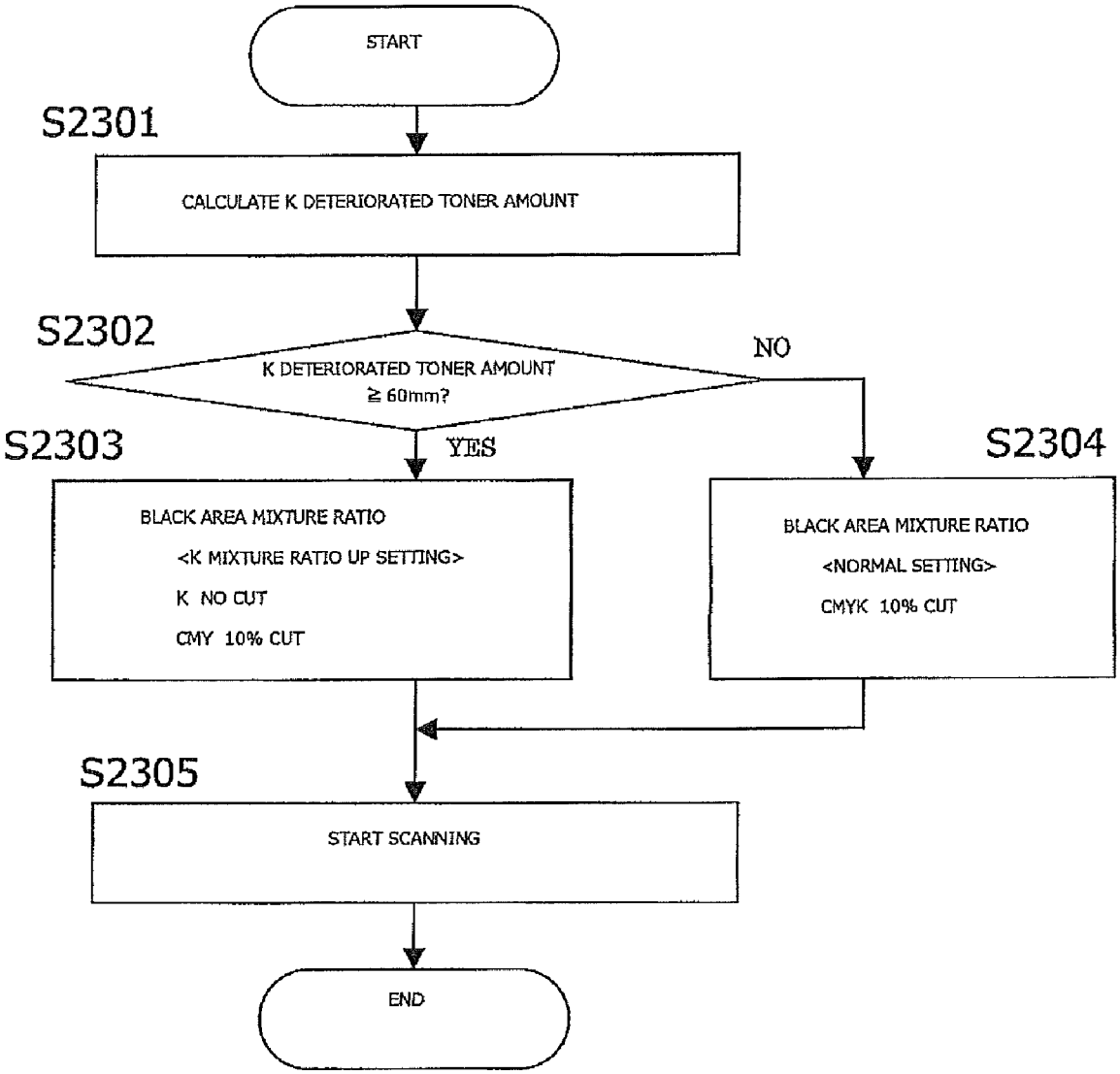
FIG. 23 is a flowchart of a mixture ratio change control before the start of copying processing (ninth embodiment)

FIG. 23 is a flowchart of a mixture ratio change control before the start of copying processing (ninth embodiment). The flow of FIG. 23 (toner save mode) corresponds to the flow of FIG. 8 (normal mode) of the first embodiment.

At step S2301, the printer controller 102 calculates the deteriorated toner amount of each color. At the next step S2302, the printer controller 102 determines whether the K deteriorated toner amount is not less than 60 mm or not. When the K deteriorated toner amount is not less than 60 mm, step S2303 is executed, and when the K deteriorated toner amount is less than 60 mm, step S2304 is executed. At step S2303, the black area mixture ratio is set to the "K mixture ratio UP setting". Temporarily, the K mixture ratio and the CMY mixture ratio are set to 70% and 30%, respectively. When the influence of the toner save mode is added, finally, the K mixture ratio is set to no cut (60%), and the CMY mixture ratio is set to 10% cut (20%). At step S2304, the black area mixture ratio is set to the "normal setting". Temporarily, the K mixture ratio and the CMY mixture ratio are set to 60% and 30%, respectively. When the influence of the toner save mode is added, finally, the K mixture ratio is set to 10% cut (50%), and the CMY mixture ratio is set to 10% cut (20%). When the black area mixture ratio is set, at step S2305, the scanner controller 103 starts reading processing.

Tenth Embodiment

Next, the copier 1 of a tenth embodiment will be described. The tenth embodiment is the same as the first embodiment except for the contents of the mixture ratio setting in the toner save mode. The contents of the mixture ratio setting in the toner save mode in the tenth embodiment are the same as those of the ninth embodiment.

In the first and ninth embodiments, the mixture ratio is set based on the toner amount of the consumption insufficiency. On the contrary, in the fourth and tenth embodiments, the mixture ratio is set based on the toner amount of the estimated consumption insufficiency.

Figure 24:
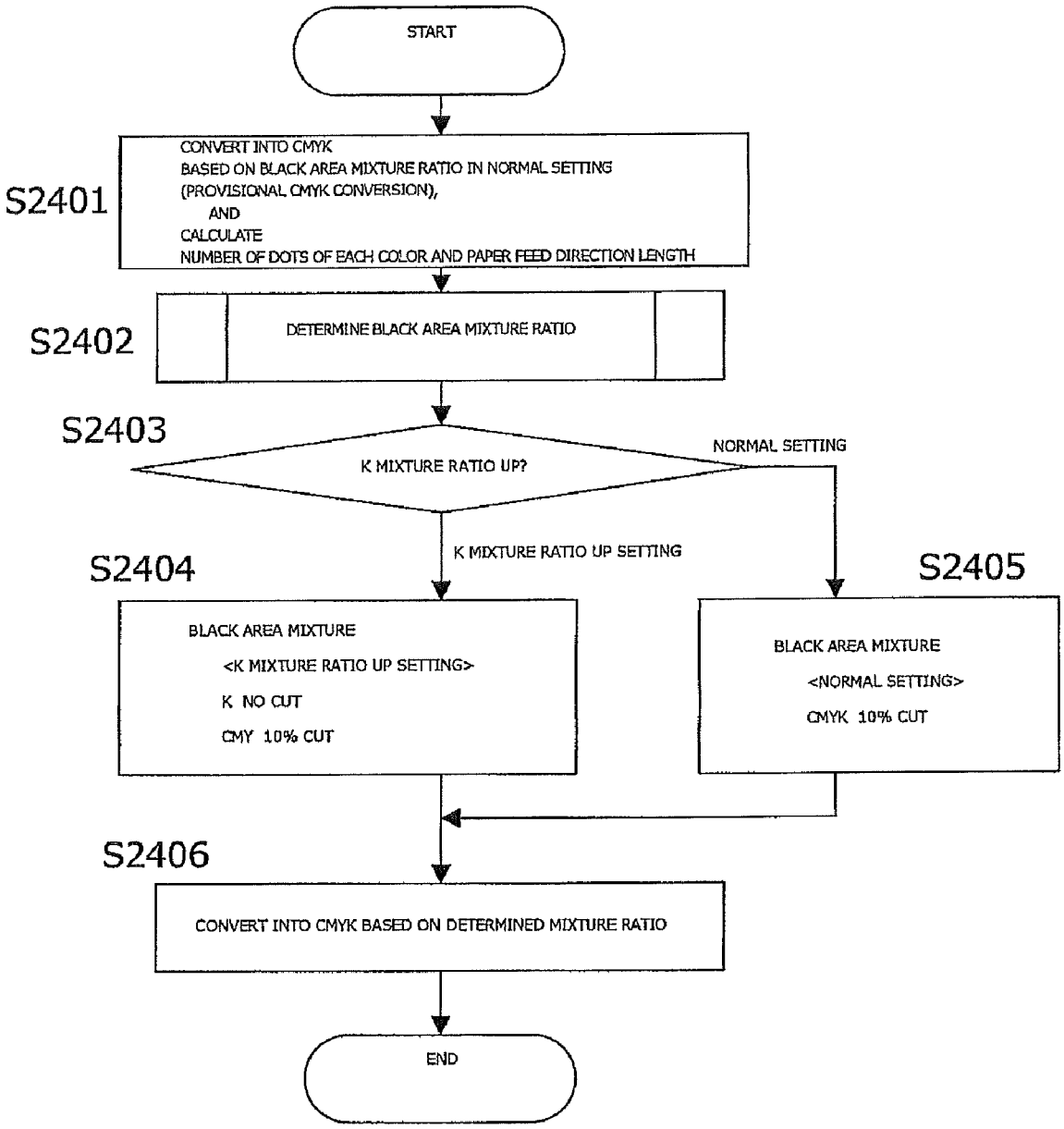
FIG. 24 is a flowchart of the conversion processing of creating image data of the CMYK system (tenth embodiment).

FIG. 24 is a flowchart of the conversion processing of creating image data of the CMYK system (tenth embodiment). The flow of FIG. 24 (toner save mode) partly corresponds to the flow of FIG. 16 (normal mode)

Steps S2401 and S2402 correspond to steps S1603 and S1604, respectively. At step S2402, the black area mixture ratio in the normal mode is determined. At the next step S2403, the scanner controller 103 determines whether the deteriorated toner information is "K mixture ratio UP" or not. When the deteriorated toner information is "K mixture ratio UP", step S2404 is executed, and when the deteriorated toner information is "normal", step S2405 is executed. At step S2404, the K mixture ratio is set to no cut (60%), and the CMY mixture ratio is set to 10% cut (20%). At step S2405, the K mixture ratio is set to 10% cut (50%), and the CMY mixture ratio is set to 10% cut (20%). At step S2406, the image data of the RGB system is, again, actually converted into image data of the CMYK system based on the determined black area mixture ratio. Prior to the actual conversion, the provisional conversion has already been executed at step S2401.

An object of the present invention is to enable the reduction in the accumulation amount of the deteriorated toner by a method other than the forcible discharge of toner in order to reduce the frequency of execution of the forcible discharge of toner.

According to a first aspect of the invention, in an image forming apparatus provided with: a data obtainer that obtains image data of an RGB system; an image data converter that generates image data of a CMYK system having a C density, an M density, a Y density and a K density by converting the image data of the RGB system; an electrostatic latent image carrier where an electrostatic latent image corresponding to the image data of the CMYK system generated by the image data converter is formed; and a developing unit that stirs toners of C, M, Y and K to be supplied to the electrostatic latent image carrier, the following are provided: a driving amount calculator that calculates a driving amount of the developing unit from a predetermined time point in the past to a present time point; a K toner amount calculator of necessary consumption that calculates a K toner amount of necessary consumption corresponding to a K toner amount to be consumed to prevent toner deterioration at the driving amount; a K toner amount calculator of cumulative consumption that calculates a K toner amount of cumulative consumption corresponding to a K toner amount actually consumed at the driving amount; and a K toner amount calculator of consumption insufficiency that calculates a K toner amount of consumption insufficiency obtained by subtracting the K toner amount of the cumulative consumption from the K toner amount of the necessary consumption. In order that black in the image data of the RGB system is expressed by a mixture of four colors C, M, Y and K in the image data of the CMYK system, the image data converter sets the C density, the M density and the Y density to a density obtained by multiplying a density of black in the RGM system by a CMY mixture ratio, and sets the K density to a density obtained by multiplying the density of black by a K mixture ratio. The image data converter sets the K mixture ratio to a K high mixture ratio that is higher than the K reference mixture ratio when TK≧PHK where TK is the K toner amount of the consumption insufficiency and PHK is a K high predetermined value.

According to a second aspect of the invention, in an image forming apparatus provided with: a data obtainer that obtains image data of an RGB system; an image data converter that generates image data of a CMYK system having a C density, an M density, a Y density and a K density by converting the image data of the RGB system; an electrostatic latent image carrier where an electrostatic latent image corresponding to the image data of the CMYK system generated by the image data converter is formed; and a developing unit that stirs toners of C, M, Y and K to be supplied to the electrostatic latent image carrier, the following are provided: a driving amount calculator that calculates a driving amount of the developing unit necessary for printing the image data of the CMYK system based on the image data of the CMYK system; a K toner amount calculator of necessary consumption that calculates a K toner amount of necessary consumption corresponding to a K toner amount to be consumed to prevent toner deterioration at the driving amount; a K toner amount calculator of estimated consumption that calculates a K toner amount of estimated consumption which is a K toner amount necessary for printing the image data of the CMYK system; and a K toner amount calculator of estimated consumption insufficiency that calculates a K toner amount of estimated consumption insufficiency obtained by subtracting the K toner amount of the estimated consumption from the K toner amount of the necessary consumption. In order that black in the image data of the RGB system is expressed by a mixture of four colors C, M, Y and K in the image data of the CMYK system, the image data converter sets the C density, the M density and the Y density to a density obtained by multiplying a density of black in the RGM system by a CMY mixture ratio, and sets the K density to a density obtained by multiplying the density of black by a K mixture ratio. The image data converter sets the K mixture ratio to a K high mixture ratio that is higher than the K reference mixture ratio when TK≧PHK, where TK is the K toner amount of the estimated consumption insufficiency and PHK is a K high predetermined value.

When the K deteriorated toner amount is increased, the amount of use of the K toner for expressing black in the RGB system is increased. Consequently, the occurrence of the deteriorated toner is suppressed for the K toner. Therefore, the frequency of forcible discharge of the deteriorated toner is reduced. In addition, the productivity of printing is improved by the reduction in the frequency of the forcible discharge.

EXPLANATION OF REFERENCE NUMERALS

1 Copier (image forming apparatus)
21C, 21M, 21Y, 21K Photoreceptor
24C, 24M, 24Y, 24K Developing units
8 CCD (data obtainer)
101 Centralized controller (copy count detection means, mode selector)
105 Network controller (data obtainer)
106 Image data converter
202 Dot count monitor (C, M, Y and K toner amount calculators of necessary consumption)
203 Development driving monitor (driving amount calculator, C, M, Y and K toner amount calculators of necessary consumption)
204 Toner amount calculator of the consumption insufficiency (C, M, Y and K toner amount calculators of consumption insufficiency)
302 Dot counter (C, M, Y and K toner amount calculators of estimated consumption)
303 Paper feed direction length calculator (driving amount calculator, C, M, Y and K toner amount calculators of necessary consumption)
304 Toner amount calculator of estimated consumption insufficiency (C, M, Y and K toner amount calculators of estimated consumption insufficiency)

The invention claimed is:

1. An image forming apparatus comprising:

a data obtainer that obtains image data of an RGB system;

an image data converter that generates image data of a CMYK system having a C density, an M density, a Y density and a K density by converting the image data of the RGB system;

an electrostatic latent image carrier where an electrostatic latent image corresponding to the image data of the CMYK system generated by the image data converter is formed;

a developing unit that stirs toners of C, M, Y and K to be supplied to the electrostatic latent image carrier;

a driving amount calculator that calculates a driving amount of the developing unit from a predetermined time point in the past to a present time point;

a K toner amount calculator of necessary consumption that calculates a K toner amount of necessary consumption corresponding to a K toner amount to be consumed to prevent toner deterioration at the driving amount;

a K toner amount calculator of cumulative consumption that calculates a K toner amount of cumulative consumption corresponding to a K toner amount actually consumed at the driving amount; and a K toner amount calculator of consumption insufficiency that calculates a K toner amount of consumption insufficiency obtained by subtracting the K toner amount of the cumulative consumption from the K toner amount of the necessary consumption, wherein in order that black in the image data of the RGB system is expressed by a mixture of four colors C, M, Y and K in the image data of the CMYK system, the image data converter sets the C density, the M density and the Y density to a density obtained by multiplying a density of black in the RGM system by a CMY mixture ratio, and sets the K density to a density obtained by multiplying the density of black by a K mixture ratio, the image data converter sets the K mixture ratio to a K reference mixture ratio when TK<PHK, and the image data converter sets the K mixture ratio to a K high mixture ratio that is higher than the K reference mixture ratio when TK≧PHK, where TK is the K toner amount of the consumption insufficiency and PHK is a K high predetermined value.

2. The image forming apparatus according to claim 1, further comprising:

C, M and Y toner amount calculators of necessary consumption that calculate C, M and Y toner amounts of necessary consumption corresponding to C, M and Y toner amounts to be consumed to prevent toner deterioration at the driving amount;

C, M and Y toner amount calculators of cumulative consumption that calculate C, M and Y toner amounts of cumulative consumption corresponding to the C, M and Y toner amounts actually consumed at the driving amount; and C, M and Y toner amount calculators of consumption insufficiency that calculate C, M and Y toner amounts of consumption insufficiency obtained by subtracting the C, M and Y toner amounts of cumulative consumption from the C, M and Y toner amounts of necessary consumption, wherein the image data converter sets the K mixture ratio to the K reference mixture ratio when TK<PHK, or when TK≧PHK, and TC≧PLC or TM≧PLM or TY≧PLY, and the image data converter sets the K mixture ratio to the K high mixture ratio when TK≧PHK, and TC<PLC and TM<PLM and TY<PLY, where TK is the K toner amount of the consumption insufficiency, PHK is the K high predetermined value, TC is the C toner amount of the consumption insufficiency, PLC is a C low predetermined value, TM is the M toner amount of the consumption insufficiency, PLM is an M low predetermined value, TY is the Y toner amount of the consumption insufficiency, and PLY is a Y low predetermined value.

3. The image forming apparatus according to claim 1, further comprising:

C, M and Y toner amount calculators of necessary consumption that calculate C, M and Y toner amounts of necessary consumption which are C, M and Y toner amounts to be consumed to prevent toner deterioration at the driving amount;

C, M and Y toner amount calculators of cumulative consumption that calculate C, M and Y toner amounts of cumulative consumption which are the C, M and Y toner amounts actually consumed at the driving amount; and C, M and Y toner amount calculators of consumption insufficiency that calculate C, M and Y toner amounts of consumption insufficiency obtained by subtracting the C, M and Y toner amounts of cumulative consumption from the C, M and Y toner amounts of necessary consumption, wherein the image data converter sets the CMY mixture ratio to a CMY reference mixture ratio when TK≧PHK, or when TK<PHK, and TC<PHC and TM<PHM and TY<PHY, or when PLK≦TK<PHK, and TC≧PHC or TM≧PHM or TY≧PHY, and the image data converter sets the CMY mixture ratio to a CMY high mixture ratio that is higher than the CMY reference mixture ratio when TK<PLK, and TC≧PHC or TM≧PHM or TY≧PHY, where TK is the K toner amount of the consumption insufficiency, PHK is the K high predetermined value, PLK is a K low predetermined value, TC is the C toner amount of the consumption insufficiency, PHC is a C high predetermined value, PLC is a C low predetermined value, TM is the M toner amount of the consumption insufficiency, PHM is an M high predetermined value, PLM is an M low predetermined value, TY is the Y toner amount of the consumption insufficiency, PHY is a Y high predetermined value, and PLY is a Y low predetermined value.

4. The image forming apparatus according to claim 1, further comprising copy count detection means for detecting a specified copy count, wherein when the same image data of the CMYK system is printed onto a plurality of sheets, the image data converter does not change the CMY mixture ratio or the K mixture ratio.

5. The image forming apparatus according to claim 1, further comprising a mode selector for selecting either a normal mode or a toner save mode as a mode of the image data converter, wherein when the toner save mode is selected and TK<PHK, the image data converter sets the K mixture ratio to a value being only a predetermined ratio lower than the K reference mixture ratio and sets the CMY mixture ratio to a value being only the predetermined ratio lower than a CMY reference mixture ratio, and when the toner save mode is selected and TK≧PHK, the image data converter sets the K mixture ratio to the K reference mixture ratio and sets the CMY mixture ratio to the value being only the predetermined ratio lower than the CMY reference mixture ratio, where TK is the K toner amount of the consumption insufficiency and PHK is the K high predetermined value.

6. An image forming apparatus comprising:

a data obtainer that obtains image data of an RGB system;

an image data converter that generates image data of a CMYK system having a C density, an M density, a Y density and a K density by converting the image data of the RGB system;

an electrostatic latent image carrier where an electrostatic latent image corresponding to the image data of the CMYK system generated by the image data converter is formed;

a developing unit that stirs toners of C, M, Y and K to be supplied to the electrostatic latent image carrier;

a driving amount calculator that calculates a driving amount of the developing unit necessary for printing the image data of the CMYK system based on the image data of the CMYK system;

a K toner amount calculator of necessary consumption that calculates a K toner amount of necessary consumption corresponding to a K toner amount to be consumed to prevent toner deterioration at the driving amount;

a K toner amount calculator of estimated consumption that calculates a K toner amount of estimated consumption which is a K toner amount necessary for printing the image data of the CMYK system; and a K toner amount calculator of estimated consumption insufficiency that calculates a K toner amount of estimated consumption insufficiency obtained by subtracting the K toner amount of the estimated consumption from the K toner amount of the necessary consumption, wherein in order that black in the image data of the RGB system is expressed by a mixture of four colors C, M, Y and K in the image data of the CMYK system, the image data converter sets the C density, the M density and the Y density to a density obtained by multiplying a density of black in the RGM system by a CMY mixture ratio, and sets the K density to a density obtained by multiplying the density of black by a K mixture ratio, the image data converter sets the K mixture ratio to a K reference mixture ratio when TK<PHK, and the image data converter sets the K mixture ratio to a K high mixture ratio that is higher than the K reference mixture ratio when TK≧PHK, where TK is the K toner amount of the estimated consumption insufficiency and PHK is a K high predetermined value.

7. The image forming apparatus according to claim 6, further comprising:

C, M and Y toner amount calculators of necessary consumption that calculate C, M and Y toner amounts of necessary consumption which are C, M and Y toner amounts to be consumed to prevent toner deterioration at the driving amount;

C, M and Y toner amount calculators of estimated consumption that calculate C, M and Y toner amounts of estimated consumption which are the C, M and Y toner amounts necessary for printing the image data of the CMYK system; and C, M and Y toner amount calculators of estimated consumption insufficiency that calculate C, M and Y toner amounts of estimated consumption insufficiency obtained by subtracting the C, M and Y toner amounts of estimated consumption from the C, M and Y toner amounts of necessary consumption, wherein the image data converter sets the K mixture ratio to the K reference mixture ratio when TK<PHK, or when TK≧PHK, and TC≧PLC or TM≧PLM or TY≧PLY, and the image data converter sets the K mixture ratio to the K high mixture ratio when TK≧PHK, and TC<PLC and TM<PLM and TY<PLY, where TK is the K toner amount of the estimated consumption insufficiency, PHK is the K high predetermined value, TC is the C toner amount of the estimated consumption insufficiency, PLC is a C low predetermined value, TM is the M toner amount of the estimated consumption insufficiency, PLM is an M low predetermined value, TY is the Y toner amount of the estimated consumption insufficiency, and PLY is a Y low predetermined value.

8. The image forming apparatus according to claim 6, further comprising:

C, M and Y toner amount calculators of necessary consumption that calculate C, M and Y toner amounts of necessary consumption which are C, M and Y toner amounts to be consumed to prevent toner deterioration at the driving amount;

C, M and Y toner amount calculators of estimated consumption that calculate C, M and Y toner amounts of estimated consumption which are the C, M and Y toner amounts necessary for printing the image data of the CMYK system; and C, M and Y toner amount calculators of estimated consumption insufficiency that calculate C, M and Y toner amounts of estimated consumption insufficiency obtained by subtracting the C, M and Y toner amounts of estimated consumption from the C, M and Y toner amounts of necessary consumption, wherein the image data converter sets the CMY mixture ratio to a CMY reference mixture ratio when TK≧PHK, or when TK<PHK, and TC<PHC and TM<PHM and TY<PHY, or when PLK≦TK<PHK, and TC≧PHC or TM≧PHM or TY≧PHY, and the image data converter sets the CMY mixture ratio to a CMY high mixture ratio that is higher than the CMY reference mixture ratio when TK<PLK, and TC≧PHC or TM≧PHM or TY≧PHY, where TK is the K toner amount of the estimated consumption insufficiency, PHK is the K high predetermined value, PLK is a K low predetermined value, TC is the C toner amount of the estimated consumption insufficiency, PHC is a C high predetermined value, PLC is a C low predetermined value, TM is the M toner amount of the estimated consumption insufficiency, PHM is an M high predetermined value, PLM is an M low predetermined value, TY is the Y toner amount of the estimated consumption insufficiency, PHY is a Y high predetermined value, and PLY is a Y low predetermined value.

9. The image forming apparatus according to claim 6, wherein the driving amount is detected based on a calculation of a length in a paper feed direction in the image data of the CMYK system.

10. The image forming apparatus according to claim 6, further comprising a mode selector for selecting either a normal mode or a toner save mode as a mode of the image data converter, wherein, when the toner save mode is selected and TK<PHK, the image data converter sets the K mixture ratio to a value being only a predetermined ratio lower than the K reference mixture ratio and sets the CMY mixture ratio to a value being only a predetermined ratio lower than a CMY reference mixture ratio, and when the toner save mode is selected and TK≧PHK, the image data converter sets the K mixture ratio to the K reference mixture ratio and sets the CMY mixture ratio to the value being only the predetermined ratio lower than the CMY reference mixture ratio, where TK is the K toner amount of the estimated consumption insufficiency and PHK is the K high predetermined value.

* * * * *